US007722044B2

(12) United States Patent
Polgár

(10) Patent No.: US 7,722,044 B2
(45) Date of Patent: May 25, 2010

(54) LOGICAL BOARD GAME AND GAME OF CHANCE ON 6×6 AND 5×7 BOARDS

(75) Inventor: László Polgár, Budapest (HU)

(73) Assignee: Laszlo Polgar, Budapest (HU)

( * ) Notice: Subject to any disclaimer, the term of this patent is extended or adjusted under 35 U.S.C. 154(b) by 0 days.

(21) Appl. No.: 11/384,852

(22) Filed: Mar. 20, 2006

(65) Prior Publication Data

US 2006/0217168 A1 Sep. 28, 2006

(30) Foreign Application Priority Data

Mar. 25, 2005 (HU) ..... PO500335

(51) Int. Cl.
*A63F 3/00* (2006.01)

(52) U.S. Cl. ..... 273/261; 273/255; 273/262

(58) Field of Classification Search ..... 273/260, 273/261; D21/348

See application file for complete search history.

(56) References Cited

U.S. PATENT DOCUMENTS 1,092,599 A * 4/1914 Schilling ..... 273/284
1,674,533 A * 6/1928 Templeton ..... 273/284
4,813,679 A * 3/1989 Hoffman ..... 273/248
5,732,947 A * 3/1998 Noack ..... 273/260
5,772,207 A * 6/1998 Caseila ..... 273/260
5,803,457 A * 9/1998 Smith ..... 273/261
6,257,578 B1 * 7/2001 Gulliver ..... 273/260
6,578,848 B1 * 6/2003 Champion et al. ..... 273/292
7,021,628 B2 * 4/2006 Reynolds ..... 273/260
7,182,341 B2 * 2/2007 Conner ..... 273/260

OTHER PUBLICATIONS

Pritchard, D.B., The Encyclopedia of Chess Variants., 137-147 (1994).

* cited by examiner

*Primary Examiner*—Vishu K. Mendiratta
(74) *Attorney, Agent, or Firm*—Foley & Lardner LLP

(57) ABSTRACT

The present invention is directed to a logical board game having a rectangular playing area made up of primary playing fields, the primary playing fields being congruent squares that are in contact with the adjacent primary playing fields on at least two of their sides; furthermore, having two equal, counter-interested sets of pieces of different colors that are designed to look identical to the pieces of traditional chess; and being complete with a computer and/or computer program that makes possible the playing and/or teaching of the game, wherein the fact that one or two further square-shaped primary playing fields are connected to the playing area in such a way that one corner of the newly added primary playing field adjoins the corner of the playing area at a common point, and this additional primary playing field plays a role in the game as necessary.

33 Claims, 42 Drawing Sheets

LOGICAL BOARD GAME AND GAME OF CHANCE ON 6×6 AND 5×7 BOARDS

CROSS-REFERENCE TO RELATED PATENT APPLICATIONS

This application claims the benefit of priority to Hungarian Patent Application No. P0500335 filed on Mar. 25, 2005.

BACKGROUND OF THE INVENTION

The subject of the invention is logical board games, which have a special playing area (board). The playing areas are rectangular (specifically: square), and comprise primary playing fields, otherwise called cells; the cells are congruent orthogonal geometrical figures, which adjoin, by at least two of their sides, their neighbouring cells, and the at the opposing ends of the playing area are baselines made up of rows of cells. The invented playing areas are protected by Hungarian design applications D 03 00347 and D 03 00348.

Furthermore, the invented board games feature two equal-numbered sets of pieces of different colors, belonging to the opposing players. The pieces are named identically to, and are preferably of a similar appearance to, the pieces used in traditional chess—major pieces and pawns-and move according to the rules of traditional and reform chess. A further characteristic of the invented board games is that, besides chess, the same board can, for example, also be used to play the following games: horse race, pawn war, French chess (also known as "Giveaway Chess," but referred to as "French Chess" throughout), halma, pyramid and checkers (shashki). In the case of halma, pyramid and checkers, the equal-numbered sets of pieces are non-figurative, preferably disc-shaped pieces (tokens), according to the established rules of these games. I have given my invention the collective name Polgár Superstar® board games, indicating that these games are members of the Polgár Superstar® family of games that are playable on the Polgár Superstar® orthogonal (6×6, 5×7) reform-chess board.

One of the most ancient known games, chess, which dates back more than 3,000 years, has an orthogonal, square-shaped playing field made up of 8×8 cells organized into vertical columns and horizontal rows usually on a board, table or box surface. Furthermore, the game features two sets of pieces made up of 16 pieces each. The pieces are shaped as figures that act in accordance with their established roles within the rules of the game. During the past five hundred years the game has been played according to the same rules as a game for two players who oppose one another as "white" and "black" in accordance with the starting move.

The large number of pieces and cells results, according to the rules, in such a large number of move combinations that the game of chess is regarded all over the world as an intellectual pursuit highly suitable for developing complex combinative abilities and, consequently for realizing various strategic and tactical concepts.

Besides traditional chess (played on an 8×8 square board, according to FIDE rules: also known as orthodox chess), a vast number of reform chess ideas have also been published. In his "Encyclopedia of Chess Variants" (Games and Puzzles Publications, Surrey, 1994), D. B. Pritchard describes almost 1,500 different varieties of reform chess. Half of these were developed before 1970, and the other half between 1970 and 1993. In the bibliography of his book he mentions some 150 works written on the subject of reform chess. In the chess-related catalogue of the Royal Library of The Hague, more than 250 works are to be found on chess games that differ from the traditional version. All this is clearly indicative of continuous and keen interest in reform chess and of the creativity it inspires.

Nor is it any coincidence that reform chess has been played by many famous chess masters, including Aliechin, Benkö, Capablanca, Hübner, Kagan, Keres, Kieseritzky, Kmoch, Landau, Marco, Maróczy, Nimzowitsch, Showalter, and the Polgár sisters.

Many chess experts and amateurs have attempted, by way of experiment, to "improve" the game of chess to some extent, while preserving its indubitably high intellectual value. Various innovations and modifications have been proposed.

One opportunity lies in changing the size of the board, or the shape and geometry of the playing field. Thus, a smaller board may result in a certain simplification and can speed up the game, since fewer pieces can be placed on the smaller board, bearing in mind the reduced size of the playing area. Examples of such games are Alapo, Apocalypse, Archer, Baby, Benighted, Bird, Chessence, Los Alamos, Microchess I and II, and Minichess I, II, III and IV etc.

There have been attempts to achieve the above goal by using playing fields differing in geometrical shape from the orthogonal, for example, triangular, rhomboid, hexagonal and star-shaped playing fields, or combinations of them.

One of the findings that led to my invention was the fact that, by using a smaller board and a reduced number of cells (even while preserving their traditional rectangular shape), the game can be made sufficiently more dynamic without sacrificing any of its other advantageous properties. On the basis of the experience acquired in the course of my investigations, the optimal number of cells appeared to be between 35 and 54; this can be realised precisely using a 5×7 or 9×6 board, although games are particularly dynamic on a board with between 35 and 40 cells (5×7 and 6×6). (I have previously produced reform-chess games for 5×8, 6×8, 8×6 and 9×6 boards.)

The other option is to introduce variations into the starting setup. The rigidity of the strictly determined starting setup of traditional 8×8 chess, characterized by the symmetry and opposition of corresponding pieces, can successfully be relaxed by making the placement of the major pieces on the baseline—both in terms of sequence and position—optional.

Grandmaster Pál Benkõ published his version of reform chess, Prechess, in 1978. Here, the placement of the major pieces in the basic setup is not determined and can be asymmetrical. Robert Fischer also proposed a non-determined placement of the major pieces on a traditional 8×8 board, although he preferred to preserve a symmetrical basic setup of the major pieces (white pieces opposite to the equivalent black ones). Since these reform-chess games involved no differences from 8×8 chess either in terms of the board or in the number of pieces, the only change they brought to the traditional game was to make the opening more difficult for the players. Prechess has not become widespread, nor have the suggestions made by American chess genius R. Fischer met with success.

While elaborating my invention I recognized that if the placement of the major pieces on the baseline is optional—in terms of both sequence and the position of each individual major piece—the baseline may already contain a large number of variations striking for their innovation and diversity compared to the uniformity of orthodox chess openings, making it highly suitable for developing combinative abilities and creativity. Since the major pieces are not placed on the baseline of the board in a predetermined order but optionally, the resulting setup may thus include multiple asymmetries, characterized by the fact that the corresponding black and white major pieces are not placed in opposition to one another. This is one of the characteristic features of the reform-chess games that can be played on the (6×6, 5×7) Polgár Superstar® reform-chess board, according to the invention.

In order to achieve a suitable dynamization of the game, to increase dramatically the number of combinations, and thereby to enhance the development of creativity in teaching the game, it is important for the pieces in play, and principally the major pieces, to have maximal strength. In order to achieve this, wherever possible two queens are used already in the starting setup in the games according to this invention.

The majority of existing reform-chess games to date have not been able to achieve the desired acceleration of play while still preserving the traditional values of chess-primarily the high level of intellectual enjoyment inspired by a game rich in brilliant combinations. In the course of further developments the majority of reform chess versions have become over-complicated, the playing areas confusing, and the games slow and cumbersome. Most of them have merely satisfied their creator's desire for innovation but have failed to become popular and are not in widespread use, presumably not being suitable for this from the outset.

SUMMARY OF THE INVENTION

In summary it can be stated that, among the logical games playable on an orthogonal (6×6, 5×7) reform-chess board according to the invention, the chess-like games exhibit the following important differences compared to existing reform-chess games and traditional chess:

- there is a smaller number of cells, and consequently of pieces too, although by doubling the number of certain major pieces (two queens) the combined strength of the major pieces is not necessarily reduced,
- by using an alternative setup of the major pieces the starting setup (position and sequence) is optional rather than fixed, thus creating some tens of thousands of possible setup variations.

Below I provide an overview of the logical board games that can be played on the invented orthogonal (6×6, 5×7) reform-chess board, beginning with chess-type games and referring, by way of comparison, to their forerunners.

6×6 chess

Hopwood developed his version, called Diana, for a 6×6 board in 1870. L'Hermitte's game was invented by S. L'Hermitte (1969), also for a 6×6 board. A. Wardley's Simpler, invented in 1977, was likewise for 6×6 board. The other game based on a 6×6 board was developed by J. Tranelis in 1982. He named his game Alapo. The pieces and their moves are somewhat different from the pieces and moves in traditional chess.

In computer chess the idea of a 6×6 board also emerged earlier. Computer researchers at the Los Alamos Scientific Laboratory (USA) (J. Kister, P. Stein, S. Ulam, W. Walden, M. Wells) were the first to develop it, and Paul Stein and Mark Wells wrote a computer chess program for it. The first computer chess program was in fact written for a 6×6 board.

In Polgár Superstar® 6×6 chess there is one king, one rook, one knight, one bishop, two queens and six pawns. The two queens make the game faster and more dynamic. (The idea of two queens was published in 1989 by G. Kuzmichov, and he used it in his "Active chess" played on a 9×8 board; in this game, however, there was only one, fixed basic setup.) In Polgár Superstar® 6×6 chess, the number of combination possibilities in the starting setup for the placement of the two different coloured major pieces on the baseline is 64,800 (6!2:8).

Compared to previously existing 6×6 reform chess versions, the chess game played on the Polgár Superstar® 6×6 board features the following essential differences:

(a) in terms of the cells:

- they are not black and white;
- the cells are not named using co-ordinates made up of the letters a, b, c, d, e and f and the numbers 1, 2, 3, 4, 5 and 6, but are numbered from 1 to 36;
- outside the board, in the left-hand corner, is a 0, which is the number 37; half of the numbers are red and the other half are black.

(b) in terms of manner of movement:

- there is no en passant capturing;
- the major pieces can be placed on the baseline in an alternative way, even by drawing lots;
- the composition of the major pieces: king, queen, queen (2×), rook, bishop and knight;
- there is no castling.

5×7 chess

Polgár Superstar® 5×7 chess differs not only in terms of the size of the board, but also in the way in which the pawns move: there is no en passant capturing, and no castling. There is one of each type of major piece, that is, one king, one queen, one rook, one bishop and one knight in each of the sets of pieces on the board, and in front of them five pawns in each set.

The numbering of the cells on the board used in the invented board games increases from left to right, and from bottom to top in columns. The white pieces are always placed at the bottom, the black pieces at the top—as in traditional chess.

In the following I will illustrate the other logical board games playable, according to the invention, on an orthogonal (6×6, 5×7) reform-chess board, using examples (sample games), but without in any way restricting the scope of the games to these examples.

The logical board game of the present invention has a rectangular playing area made up of primary playing fields, the primary playing fields being congruent squares having four edges in which at least two edges are in contact with adjacent primary playing fields. The board includes a first playing field having a first edge adjacent to a second edge that are connected to form a first primary corner of the board. The board further includes a first row of playing fields connecting to and extending from the first playing field comprising a plurality of interlocking playing fields each having a pair of edges parallel to the first edge of the first playing field. The first row of playing fields terminates in a last playing field having two edges that connect to form a second primary corner of the board. The board further includes a second row of playing fields connecting to and extending from the first playing field comprising a plurality of interlocking playing fields each having a pair of edges parallel to the second edge of the first playing field. The second row of playing fields terminates in a last playing field having two edges that connect to form a third primary corner of the board. The board further includes a plurality of internal rows of playing fields parallel to the first row of playing fields and connecting to and perpendicular to the second row of playing fields, each internal row of playing fields extending from a playing field of the first second row of playing fields. The board further includes an external playing field adjacent to the third primary corner of the board, the external playing field connecting to the last playing field of the second row of playing fields by a point and the external playing field not sharing any common edges with the last playing field of the second row of playing fields.

DETAILED DESCRIPTION OF THE PREFERRED EMBODIMENTS

Sample Games

Example 1: Horse race 6×6

Figure 1:
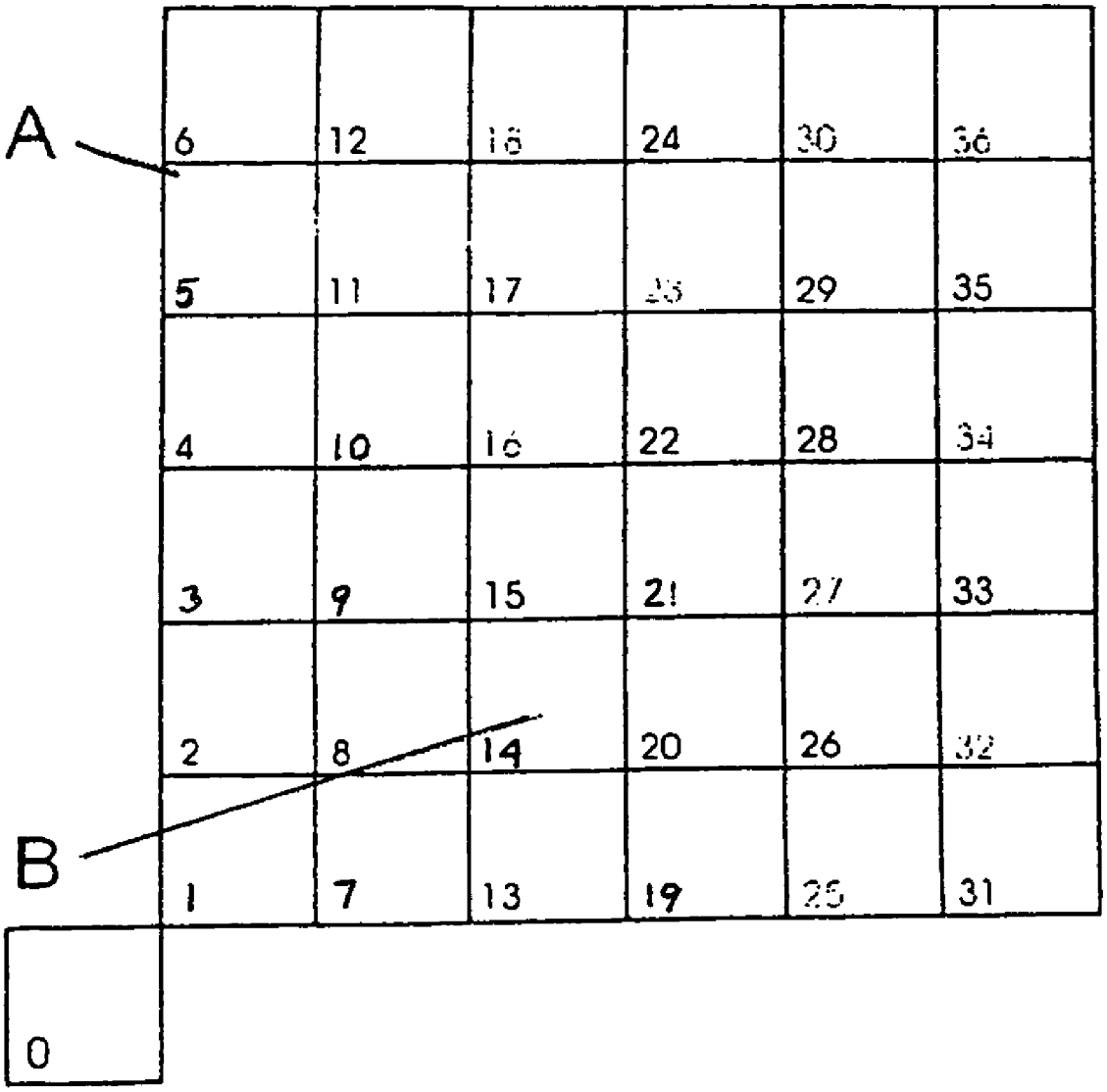
FIG. 1 shows an empty playing area (A), in keeping with one of the design formats (6×6), which comprises 37 numbered cells (B) with the adjoining cell denoted by 0.
Figure 2:
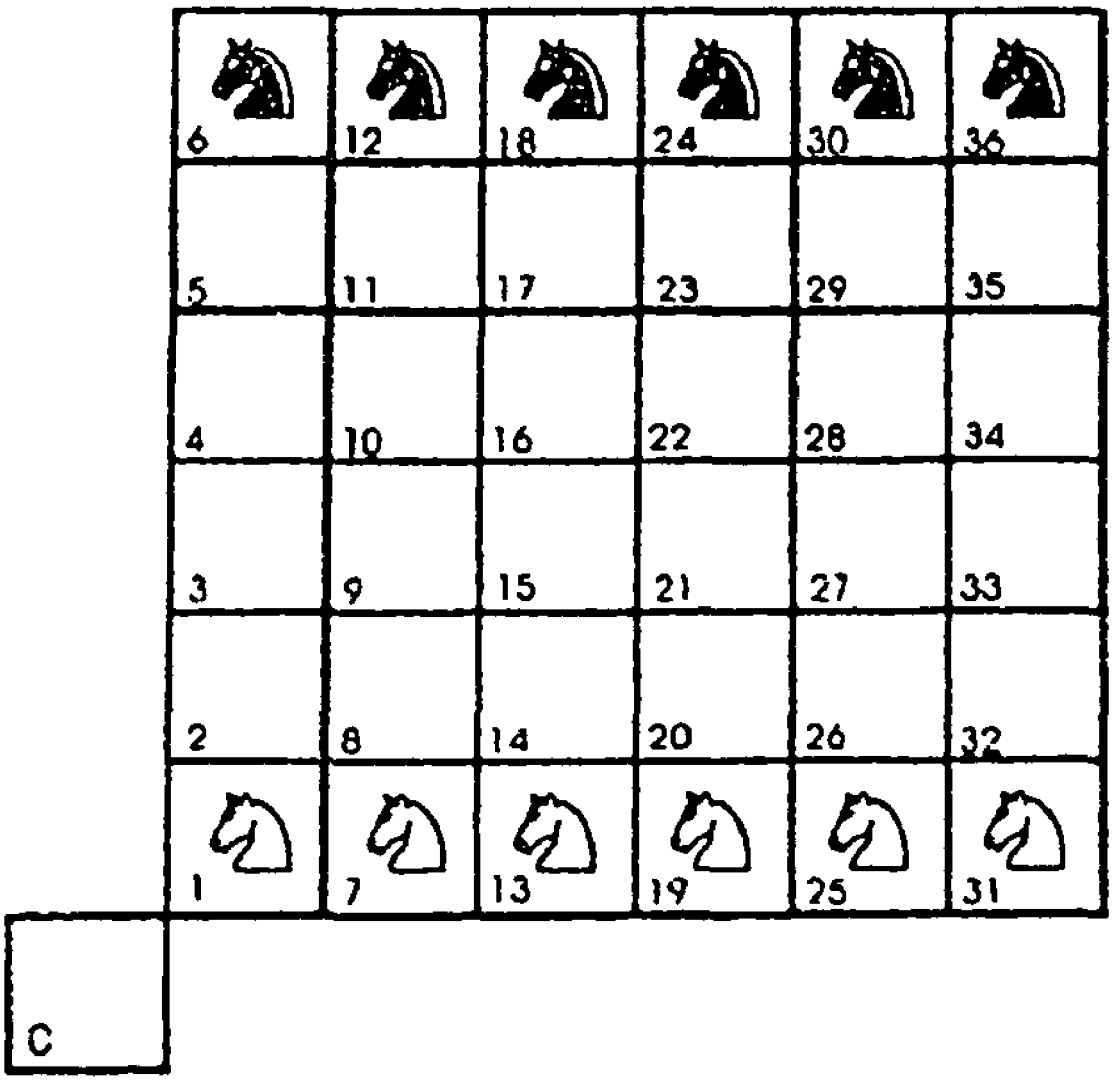
FIG. 2 shows the playing area set out for horse race.

A game for two players. Instead of pieces and pawns, only knights are placed on the baseline. Capturing is possible. Aim: To take over, with one's own knights, the starting position of the opponent's knights. The winner may not finish with fewer knights on the board. FIG. 2 shows a starting setup; below I also offer a sample game that demonstrates the specific characteristics of this game on this board.

Sample game:

1.♘19-27 ♘24-16 2.♘27-16 ♘12-16 3.♘7-20 ♘16-20 4.♘31-20 ♘6-10 5.♘13-21 ♘10-21 6.♘25-21 ♘30-22 7.♘1-9 ♘22-9 8.♘20-9 ♘36-28 9.♘9-17 ♘28-17 10.♘21-17 ♘18-22 11.♘17-6 1:0

Example 2: Pawn war 6×6

Figure 3:
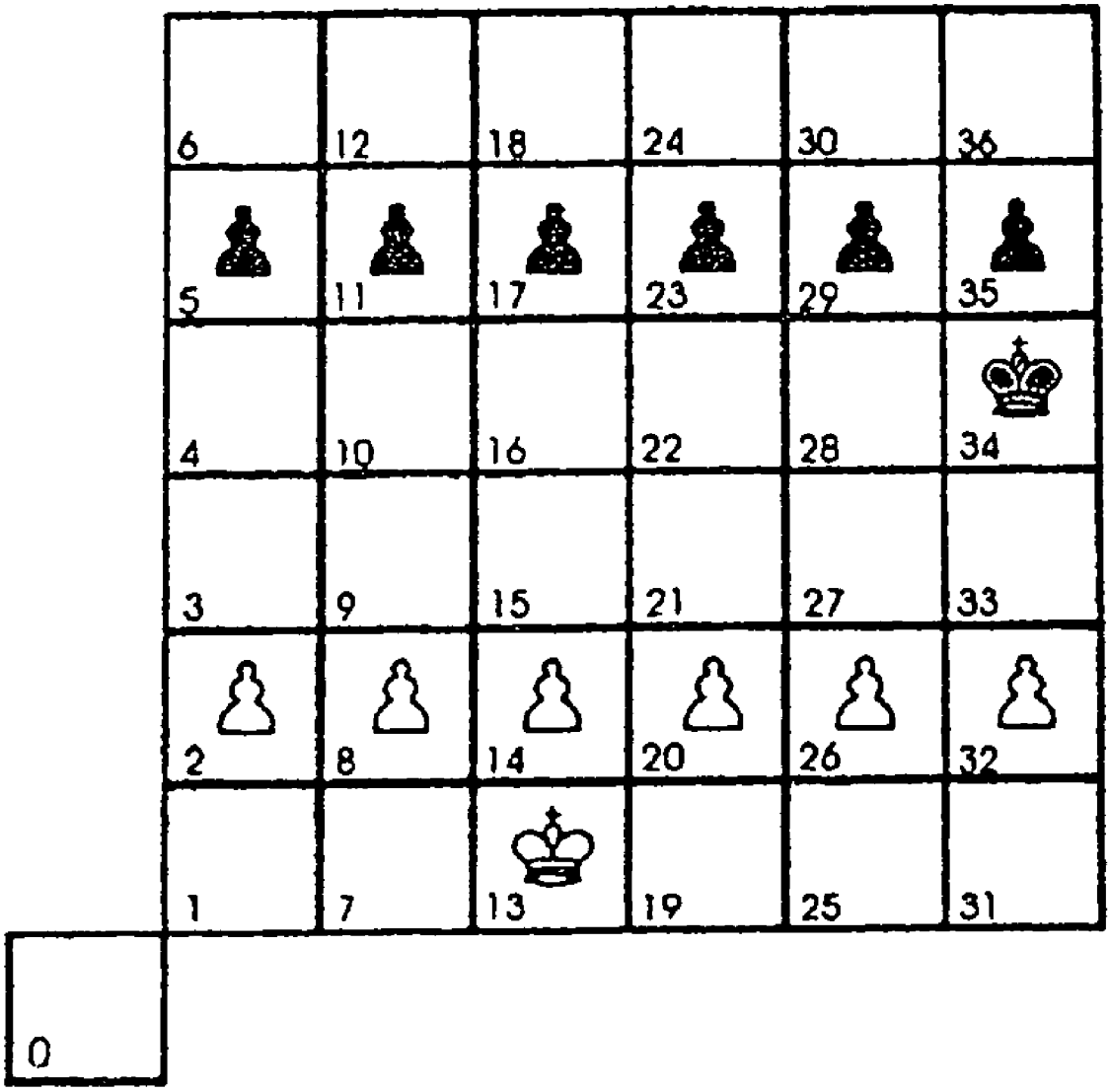
FIG. 3 shows the playing area set out for pawn war.

A game for two players. In the basic setup there are only one king and five pawns of each colour on the board. The kings may be placed anywhere on the board, in front of or behind the pawns. If a player's pawn reaches the opponent's first or last line (baseline), the pawn must be promoted into a queen, rook, knight or bishop. Aim: To checkmate the opponent's king. The game may also finish in a draw. FIG. 3 shows a starting setup; below I also offer a sample game that demonstrates the specific characteristics of this game on this board.

Sample game:

1.32-33 29-28 2.33-28 23-28 3.26-27 ♔34-33 4.8-10!! 17-10 (4.-5-10 5.14-16 11-16 6.2-4 1:0) 5.2-4 11-4 6.14-16 ♔33-26 7.16-17 35-33 8.17-18♕33-32 9.♔18-16 ♔26-25 10.20-22 32-31♔11.♔16-31 ♔25-31 12.22-23 ♔31-26 13.23-24♔1:0

Example 3: French chess 6×6

A game for two players. The major pieces are placed on the bottom and top lines. To begin the game the players place the major pieces on the board one by one, in alternating order.

Figure 4:
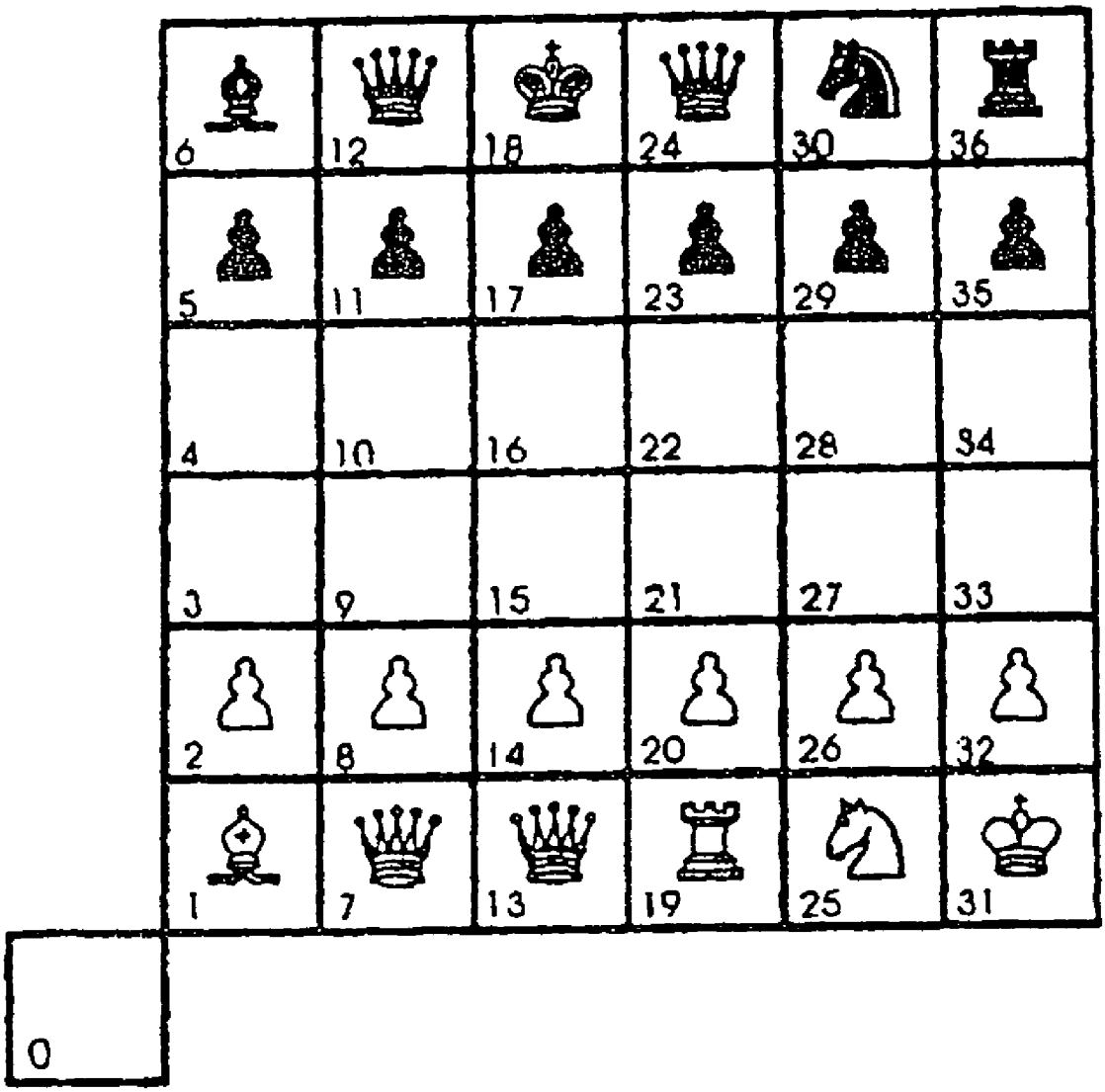
FIG. 4 shows the playing area set out for French chess.

The pawns are placed in front of the major pieces. A player may not capture his or her own pieces, but an opponent's piece (or one of them) that can be captured must be captured. Pawn promotion is possible. Exceptions, differences: the king may move into check and the king may be captured. If one of the players is unable to move, then the opposing pawns change places, and this counts as a move. Aim: To have all one's pieces captured by one's opponent. The player who has all of his/her pieces captured, wins. If neither player is able to move, the game ends in a draw. The game also ends in a draw if neither of the sides is able to sacrifice a piece. FIG. 4 shows a starting setup; below I also offer a sample game that demonstrates the specific characteristics of this game on this board.

Sample game:

1.14-16 11-16 2.♕13-16 ♕12-8 3.♕7-8 ♛6-16 4.♕8-29 ♛16-2 5.♕29-23 ♕29-23 6.♛1-36 ♛2-7 7 ♜19-7 ♕24-29 8.♛36-29 ♔23-29 9.26-28 35-28 10.32-34 ♔29-34 11.♘25-21 28-21 12.♔31-26 21-26 13.20-22 17-22 14.♜7-10 5-10 1:0

Example 4: Halma 6×6

Figure 5:
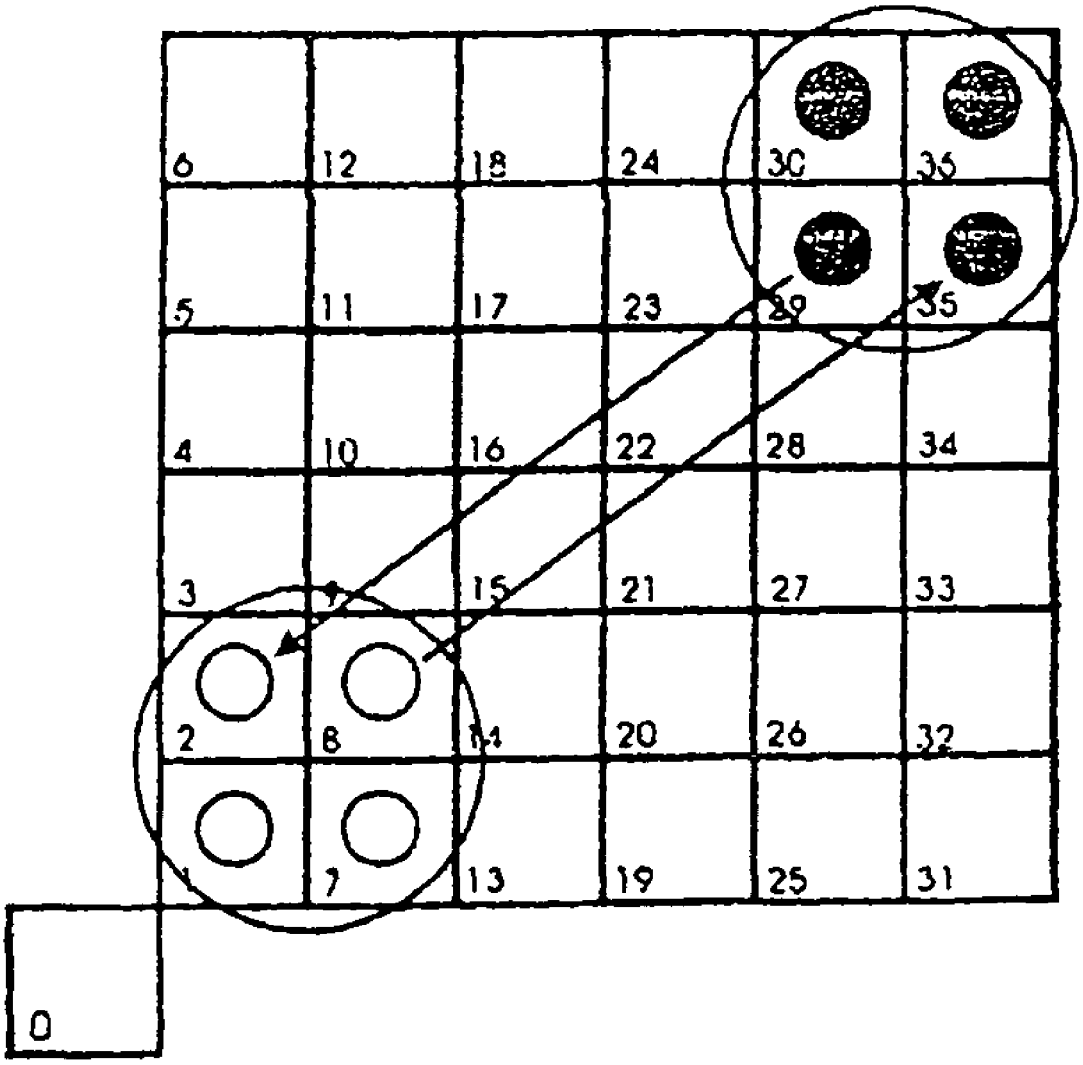
FIG. 5 shows the playing area set out for halma.

A game for two or four players. Each player has four pieces, which can move horizontally, vertically or diagonally. There is no capturing. Jumping is allowed (as is jumping in series). Pieces may also move backwards. Pieces that are jumped over may not be captured. Aim: To occupy, by moving diagonally, the starting positions of the opposing pieces. The player who is first to occupy the opponent's cells is the winner (players must leave their own starting cells in seven moves). The game is similar to pyramid, but here pieces can move both vertically and horizontally. The pieces may be tokens, but may also be identical chess pieces, for example pawns. FIG. 5 shows a starting setup; below I also offer a sample game that demonstrates the specific characteristics of this game on this board.

Sample game:

1.7-9 30-28 2.1-3 36-34 3.2-16 34-22 4.9-23 29-17-15-1 5.3-9 22-10 6.16-30 35-21 7.9-11 28-14-2 8.11-17 21-14 9.8-20 14-8 10.17-29 10-9 11.20-27 9-7 0:1

Example 5: Pyramid 6×6

Figure 6:
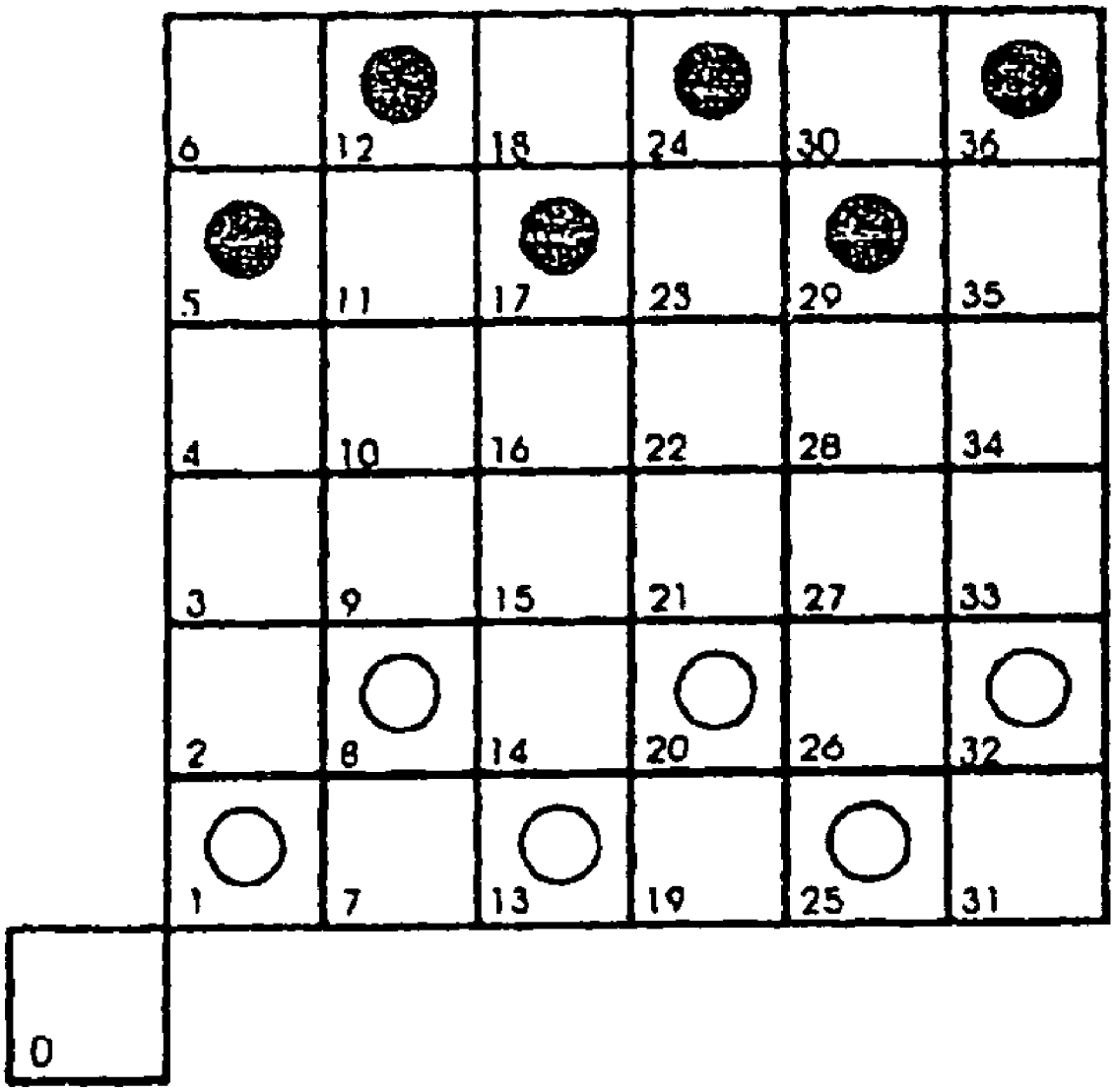
FIG. 6 shows the playing area set out for pyramid.

This game is similar to halma, but pieces may not move vertically or horizontally. Pieces may move only diagonally. They may also move backwards. There is no capturing. Jumping is allowed. Series of jumps are also permitted. Pieces that are jumped over may not be captured. Aim: To reach the opponent's starting position. A game for two players. FIG. 6 shows a starting setup; below I also offer a sample game that demonstrates the specific characteristics of this game on this board.

Sample game:

1.1-15 12-22 2.20-10 17-3 3.10-17 22-12 4.15-22 29-15-1 5.32-27 5-10 6.27-34 10-15 7.34-29 15-20 8.25-15 20-25 9.15-10 25-32 10.10-5 32-25 11.29-34 36-29 12.22-36 29-22 13.34-29 24-34 14.13-20 34-27 15.20-34-24 22-32 16.8-15 12-22-8 17.15-22 3-13 18.22-12 1:0

Example 6: Checkers (Shashki) 6×6

A game for two players. The game is similar to pyramid. Pieces may move only diagonally. Pieces may not move backwards. Jumping is allowed (as is jumping in series). If a player jumps over an opponent's piece, the piece or pieces that have been jumped over must be captured. If a player's pieces reach the opponent's starting cells, then a Queen is introduced, which can may move and capture backwards. Aim: To capture all the opponent's pieces, or to create a position in which the opponent is unable to move, creating stalemate. The game can also finish in a draw.

Figure 7:
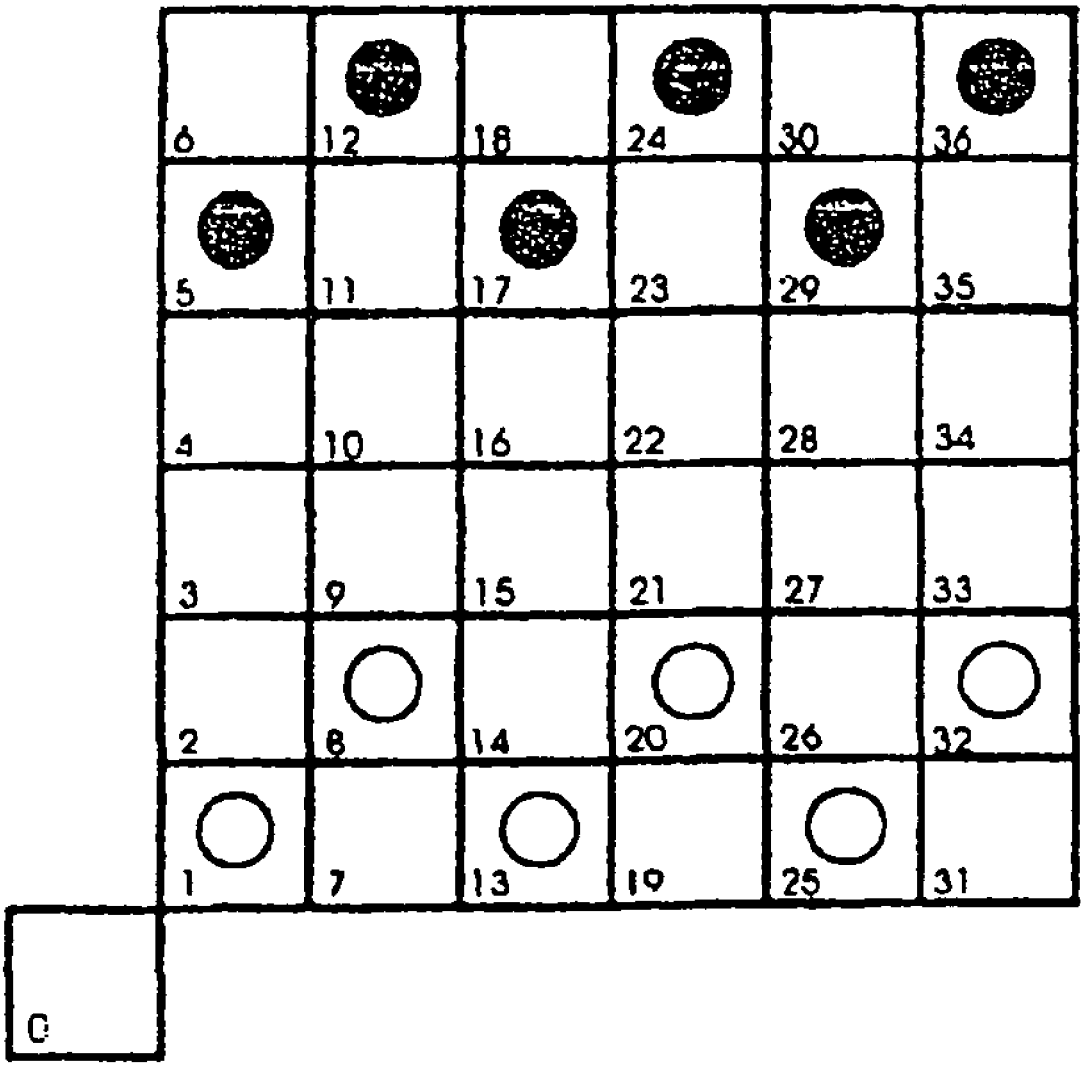
FIG. 7 shows the playing area set out for checkers (shashki)

FIG. 7 shows a starting setup; below I also offer a sample game that demonstrates the specific characteristics of this game on this board.

Sample game:

1.1-15 29-22 2.15×29 36×22 3.8-15 22×8 4.13×3 17-10 5.3×17 12×22 6.20-27 22-15 7.32-22 15-8 8.25-20 8-1D 9.20-15 5-10 10.15×5 D1×36 11.5-12D 24-17 12.D12×22 D36×8 13.27-34 D8-15 14.34-29 D15×36 0:1

Figure 8:
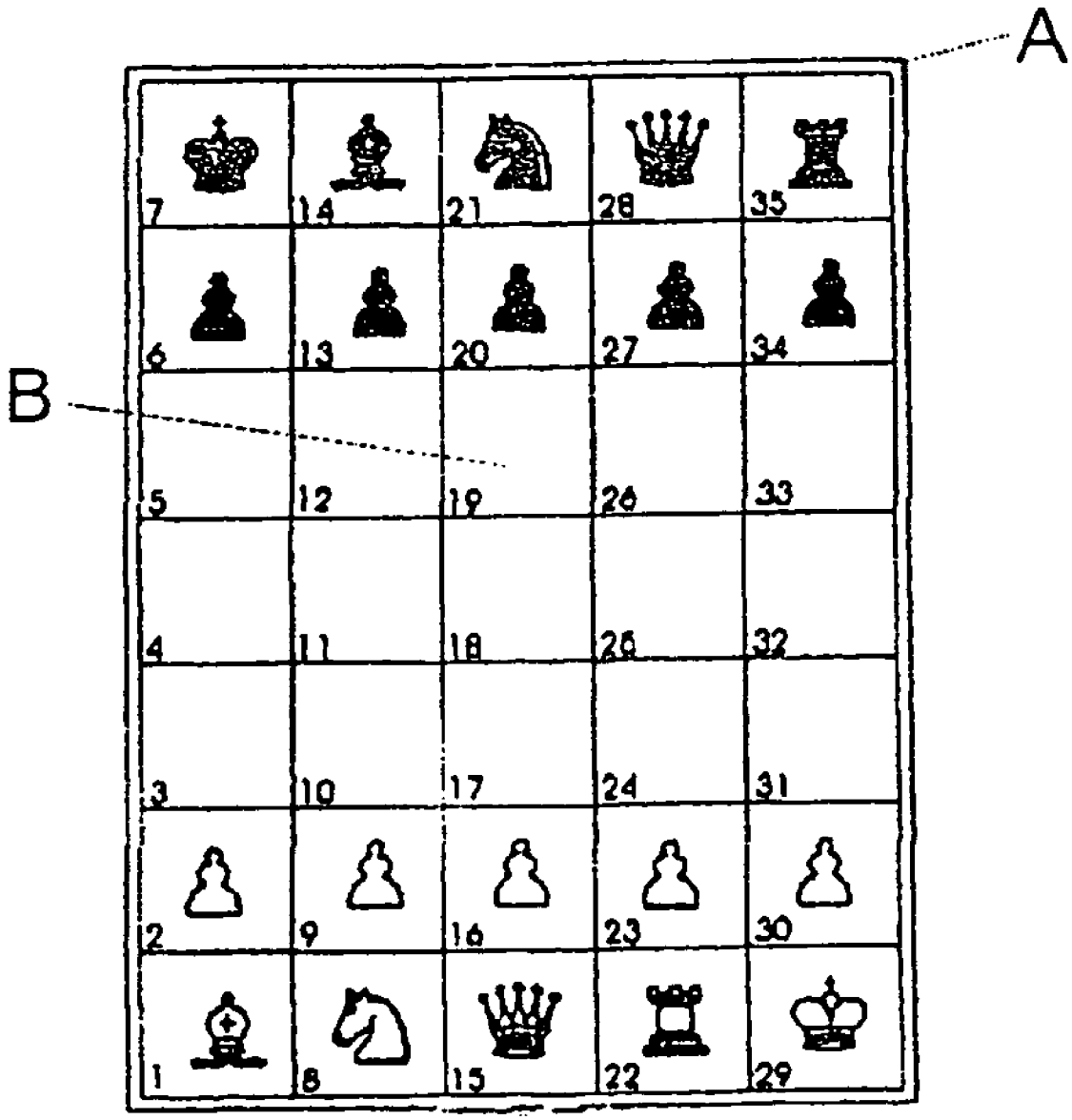
FIG. 8 shows the playing area (A) according to the other design format (5×7), comprising 35 numbered cells (B) with chess pieces in the starting position.

FIG. 8 shows the playing area (A) made up of 35 numbered cells (B) according to the other design format (5×7), with chess pieces in the starting position. As shown in the diagram, there is one of each type of major piece, that is, one king, one queen, one rook, one bishop and one knight in each of the sets of pieces on the board, and in front of them five pawns in each set. There is no en passant capturing and no castling. With the above exceptions this game of reform chess can be played according to the rules of traditional chess, thus I will not provide a specific example.

Example 7: Horse race 5×7

Figure 9:
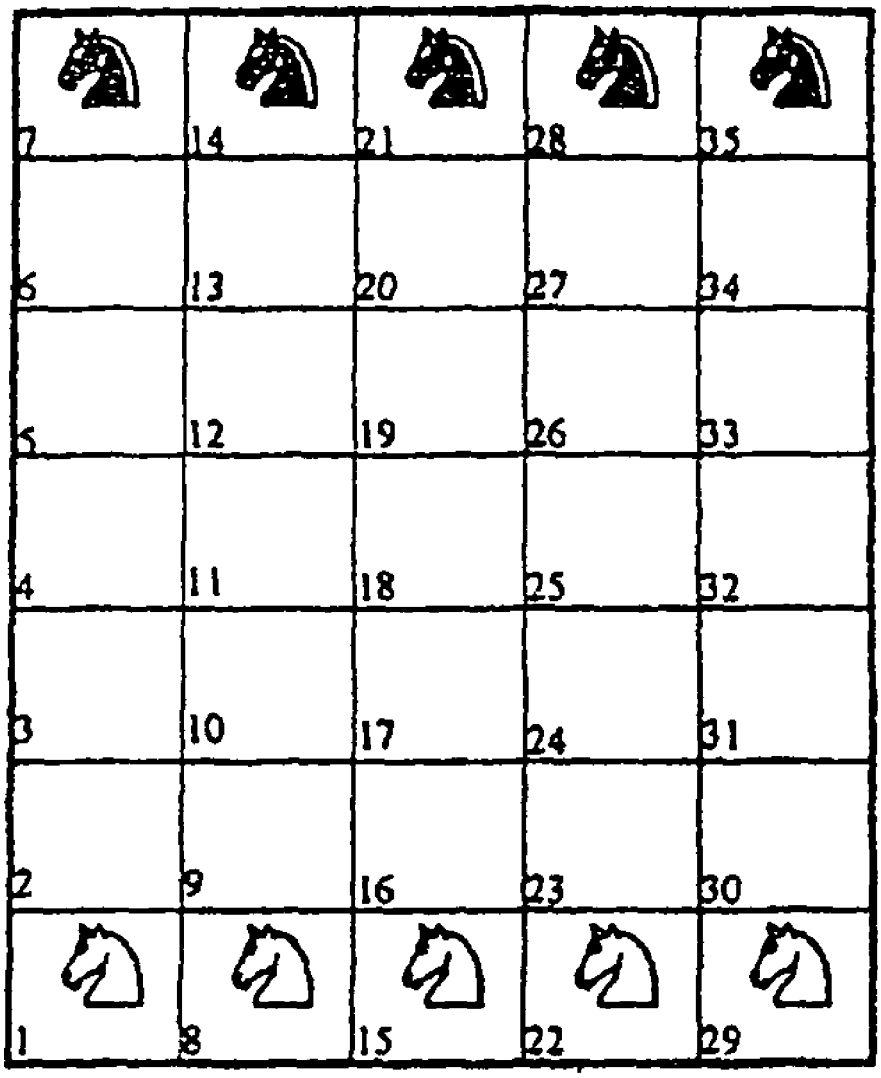
FIG. 9 shows the playing area set out for horse race.

This game is essentially similar to the game of horse race shown in example 1 on a 6×6 board. The rules are identical, the differences arising only from the size of the board. FIG. 9 shows a starting setup; below I also offer a sample game that demonstrates the specific characteristics of this game.

Sample game:

1.♘1-10 ♘14-19 2. ♘8-17 ♘7-12 3. ♘29-24 ♘19-6 4. ♘15-2 ♘35-20 5. ♘22-31 ♘28-13 6. ♘10-19 ♘6-19 7. ♘24-19 ♘12-3 8.♘19-14 ♘21-34 9. ♘31-26 ♘13-26 10.♘17-26 ♘34-25 11.♘26-21 ♘3-8 12.♘2-15 ♘25-16 13.♘15-24 ♘20-25 14.♘24-19 ♘16-29 15.♘19-28 1:0

Example 8: Pawn war 5×7

Figure 10:
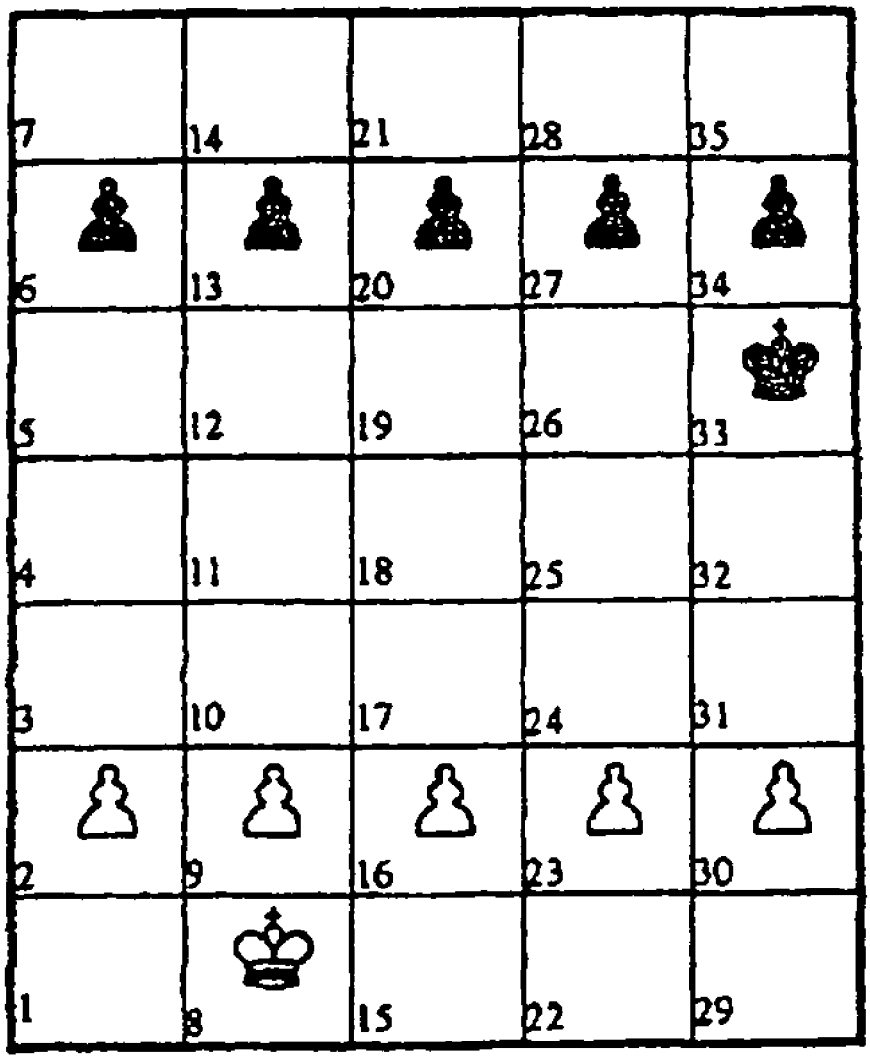
FIG. 10 shows the playing area set out for pawn war.

This game is essentially similar to the game of pawn war shown in example 2 on a 6×6 board. The rules are identical, the differences arising only from the size of the board. FIG. 10 shows a starting setup; below I also offer a sample game that demonstrates the specific characteristics of this game.

Sample game:

1.23-24 9-7 2.♔17-23 15-13 3.♔23-30 ♔21-15 4.♔30-31 7-6 5.18-13 ♔15-14 6.24-25 (6.12-6 20-18 0:1) ♔14-13 7.♔31-24 6-12 8.5-12 20-19 0:1

Example 9: French chess 5×7

Figure 11:
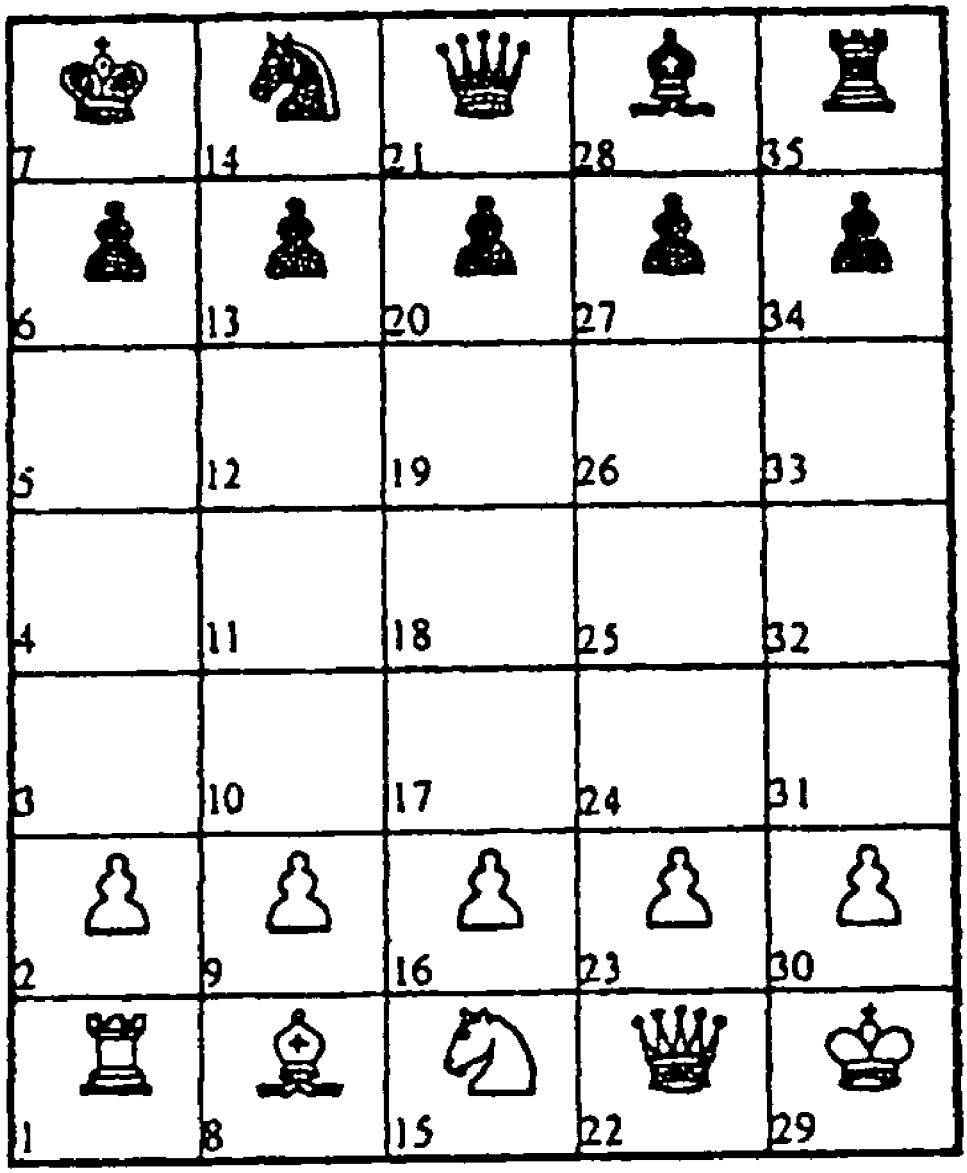
FIG. 11 shows the playing area set out for French chess.

This game is essentially similar to the game of French chess shown in example 3 on a 6×6 board. The rules are identical, the differences arising only from the size of the board. FIG. 11 shows a starting setup; below I also offer a sample game that demonstrates the specific characteristics of this game.

Sample game:

1.2-3 13-11 2.3-11 ♘14-19 3.♖1-6 ♔7-6 4.11-19 27-19 5.23-25 19-25 6. ♕22-25 ♕21-33 7.♕25-28 ♕33-9 8.♕28-20 ♕9-15 9.♕20-34 ♕15-29 10.♕34-6 ♕29-30 11.6-30 ♖35-30 12.♕8-2 ♖30-16 13.♕2-18 ♖16-18 1:0

Example 10: Halma 5×7

Figure 12:
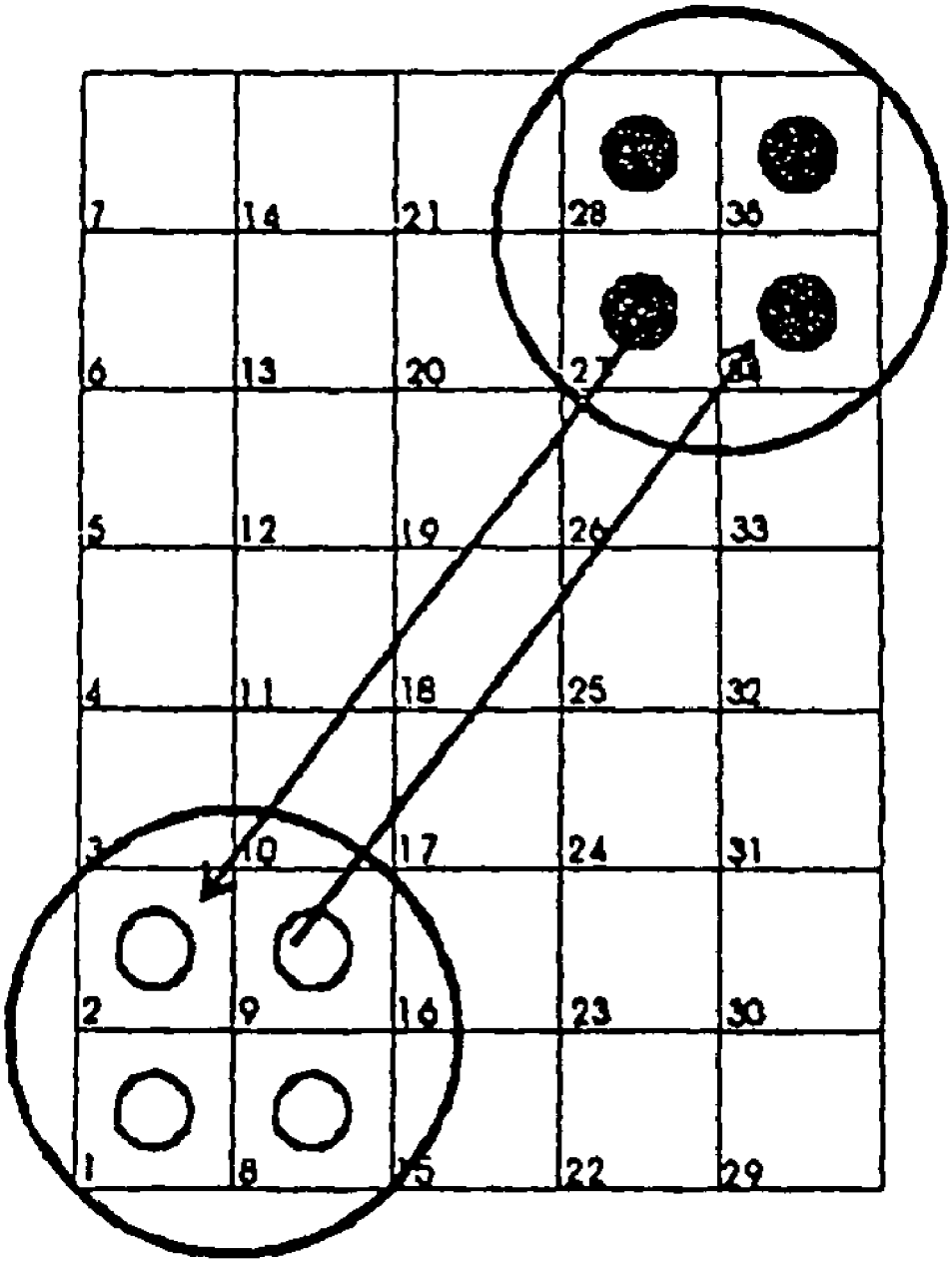
FIG. 12 shows the playing area set out for halma.

This game is essentially similar to the game of halma shown in example 4 on a 6×6 board. The rules are identical, the differences arising only from the size of the board. FIG. 12 shows a starting setup; below I also offer a sample game that demonstrates the specific characteristics of this game.

Sample game:

1.1-17 35-19 2.2-16-18-20 28-26-10 3.8-10 34-18-16-2 4.20-34 27-11 5.10-12 19-3-1 6.9-25-27 11-10 7.12-19 10-9 8.19-33-35 26-19 9.17-25 19-12 10.25-26 12-11 11.26-28 1:0

Example 11: Pyramid 5×7

Figure 13:
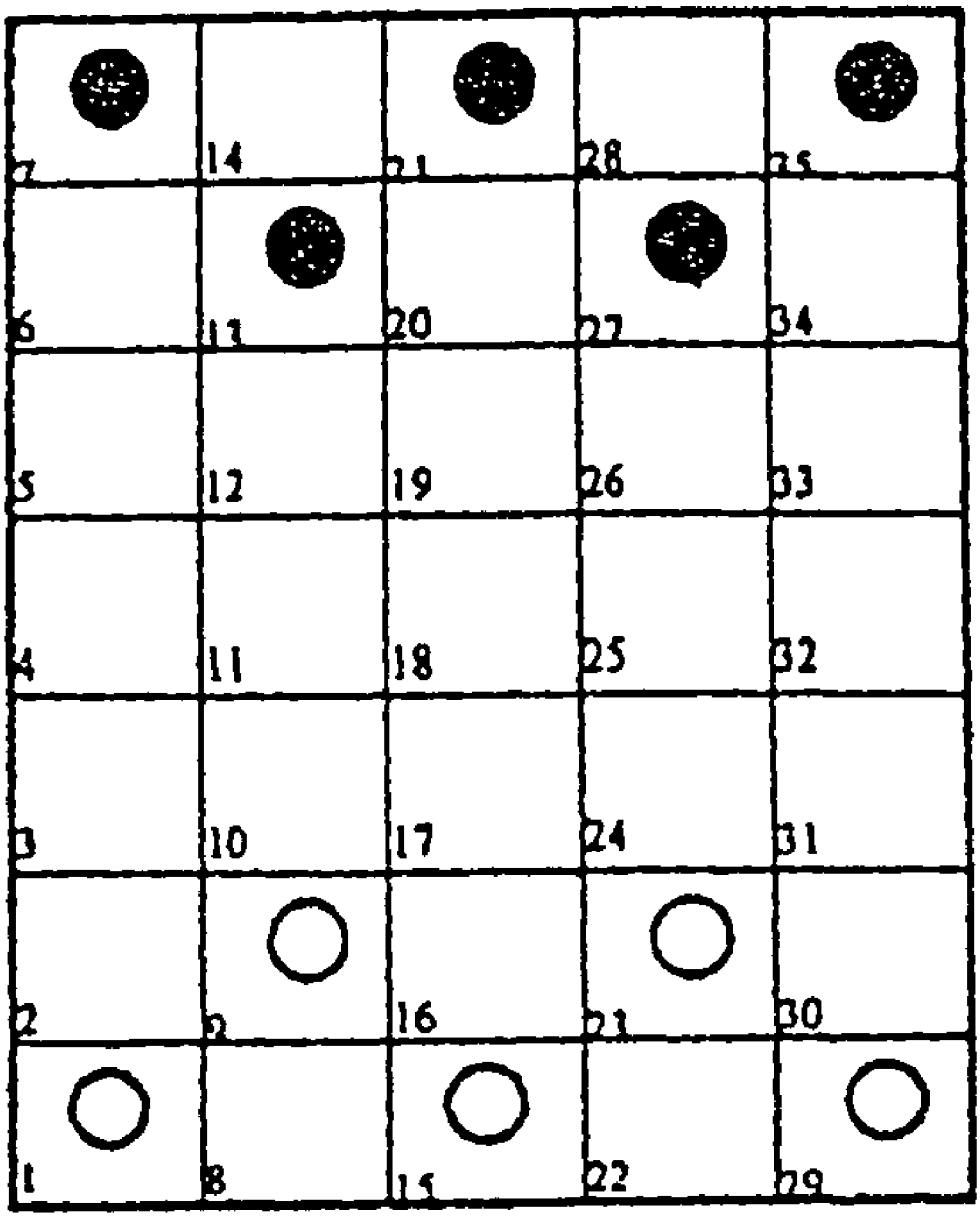
FIG. 13 shows the playing area set out for pyramid.

This game is essentially similar to the game of pyramid shown in example 5 on a 6×6 board. The rules are identical, the differences arising only from the size of the board. FIG. 13 shows a starting setup; below I also offer a sample game that demonstrates the specific characteristics of this game.

Sample game:

1.1-17 35-19 2.15-31 21-5 3.23-11 19-3-15 4.9-25 7-19-3 5.17-33-21 5-17 6.31-19-7 3-9 7.25-33 17-1 8.29-23 1-17-29 9.23-17 13-5 10.33-25 27-33 11.25-19 33-25 12.17-33 5-17-1 13.11-27 25-31 14.19-35 31-23 0:1

Example 12: Checkers (shashki) 5×7

Figure 14:
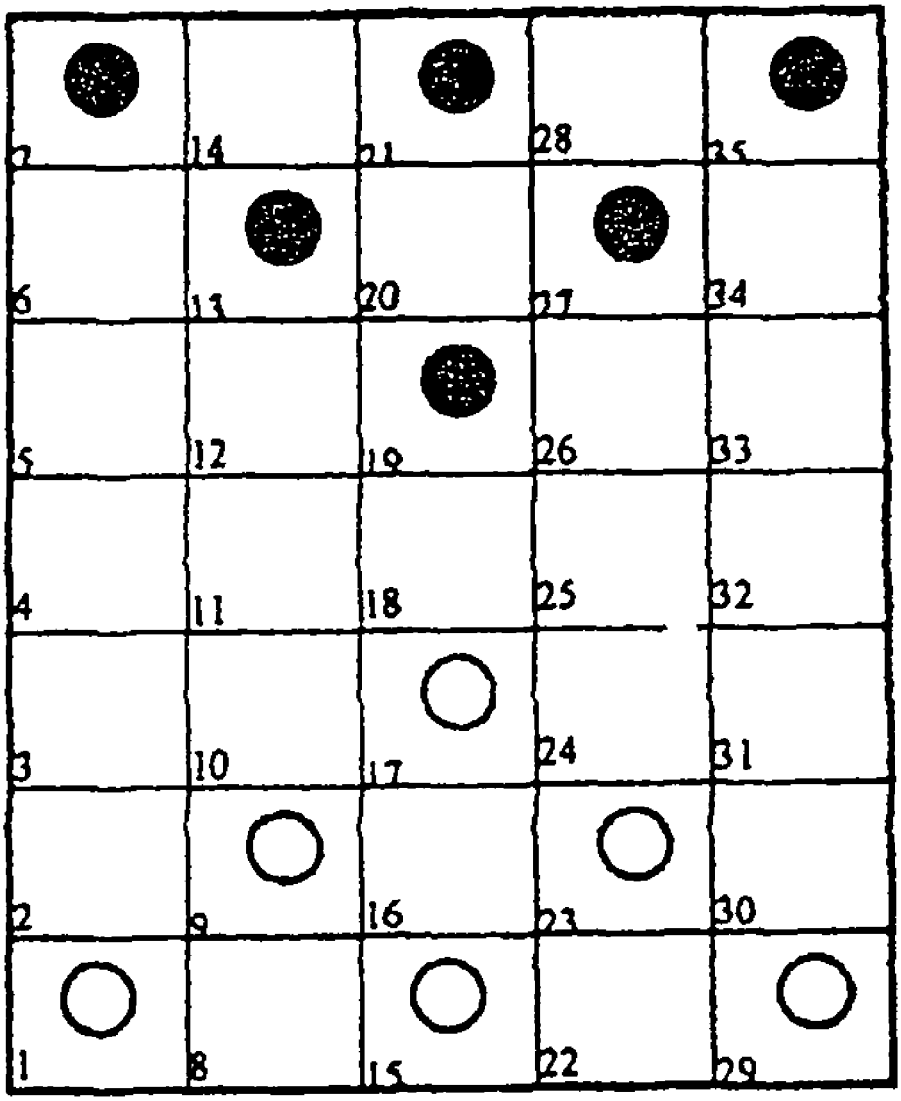
FIG. 14 shows the playing area set out for checkers (shashki)

This game is essentially similar to the game of checkers (shashki) shown in example 6 on a 6×6 board. The rules are identical, the differences arising only from the size of the board. FIG. 14 shows a starting setup; below I also offer a sample game that demonstrates the specific characteristics of this game.

Sample game:

1.13-5 9-25-13 2.7-19 15-9 3.27-11 9-25-13 4.11-3 23-11 5.3-9 11-19 6.21-27 19-7D 7.9-15D 17-25 8.35-19-31 29-23 9.5-11 7-19-35 10.11-3 1-9 white wins because no further move can be made 1:0.

The other essential feature of my invention is that board games that already exist in their own right containing elements of games of chance—such as lotto, roulette, dreidel, blackjack, or various roulette-like games played with chess pieces, such as (chess-) queen roulette, rook-bishop roulette, king-knight-two pawn roulette or lotto chess—can become new, enjoyable, game-of-chance board games by using a new-style playing area and by using the rules that I have modified to suit the new-style playing area that I have invented.

The above-mentioned new-style playing area is formed by adding to the previously existing 6×6 or 5×7 playing area one or two further primary playing fields-square-shaped and congruent with the other primary playing fields—in such a way that one corner of the newly added primary playing field adjoins the corner of the playing area at a common point. This additional primary playing field (or fields) (referred to as 0, 36 or 00) plays any desired function(s) in the course of the game.

Games containing elements of games of chance according to the invention:

(chess-) queen roulette,
rook-bishop roulette,
king-knight-two pawn roulette,
lotto,
lotto chess (TV- and casino versions)
roulette,
dreidel,
blackjack.

Below I will explain and exemplify the designs of the new board game inventions, along with the relevant playing rules.

The above game-of-chance type games can be played on the Polgár Superstar® 6×6 board. These are shown in examples 13 to 20.

(Chess-) Queen roulette (example 13)

Each player (1-4) places two bets. A number is drawn to which the queen will be placed. The chess queen can move diagonally as well as vertically. If the betting chip is in the same diagonal or column as the chess queen, the player wins. If the chip is on the identical number as the queen, the player of course wins. 0=37, that is, it functions as any other number. The player determines the size of the bet.

Figure 15:
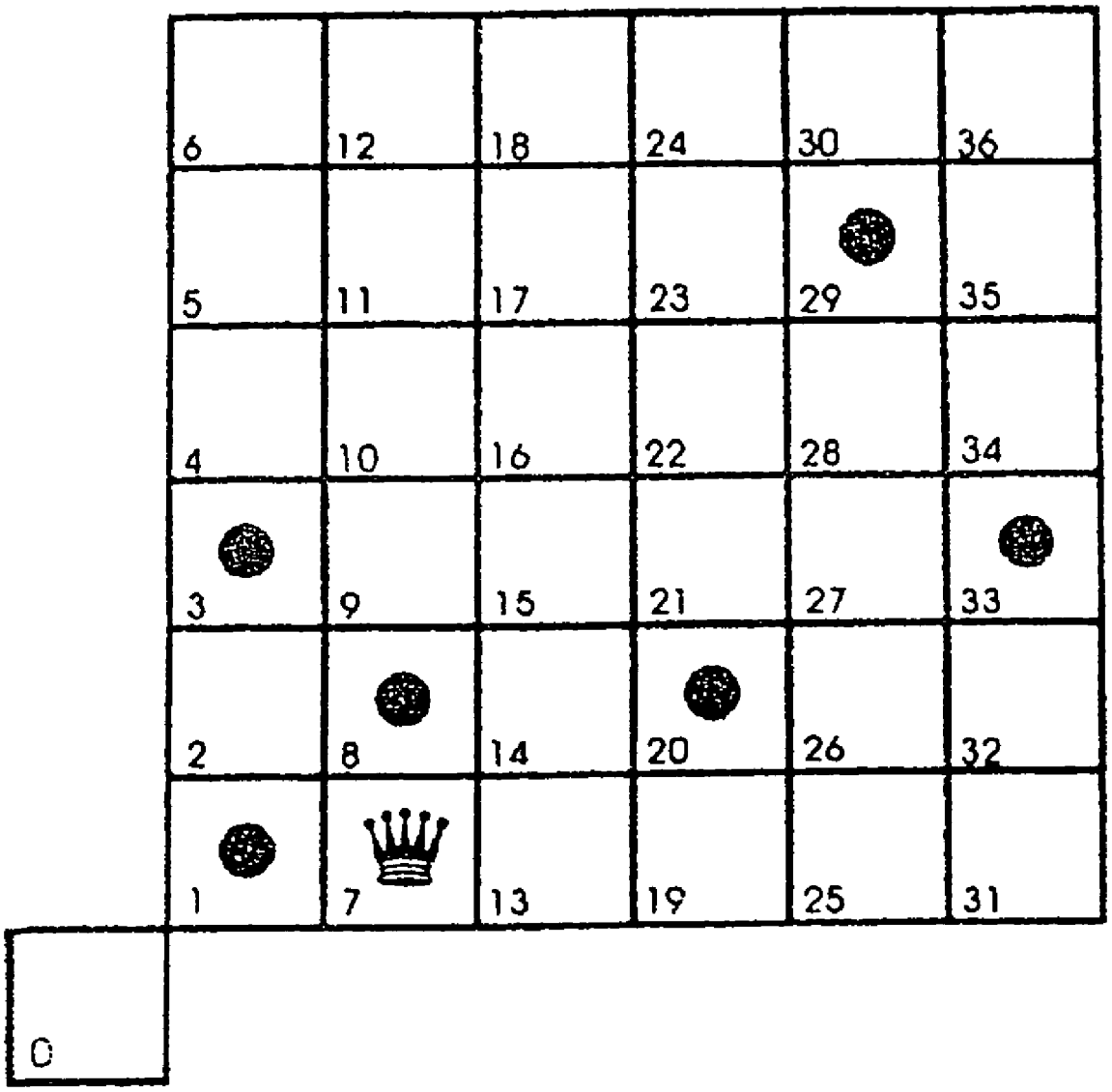
FIGS. 15-42 show playing areas of other embodiments of the present invention.

For example: The players place bets on cells 1, 3, 8, 20 and 33, and the queen is drawn on cell 7, as shown in FIG. 15. Bets placed on cells 1 and 8 are won, and tokens placed on 3, 20, 29 and 33 are lost.

In the case of a winning chip, the player receives double the bet placed, while in the case of a losing chip, the bet is lost.

Rook-bishop roulette (example 14)

Figure 16:
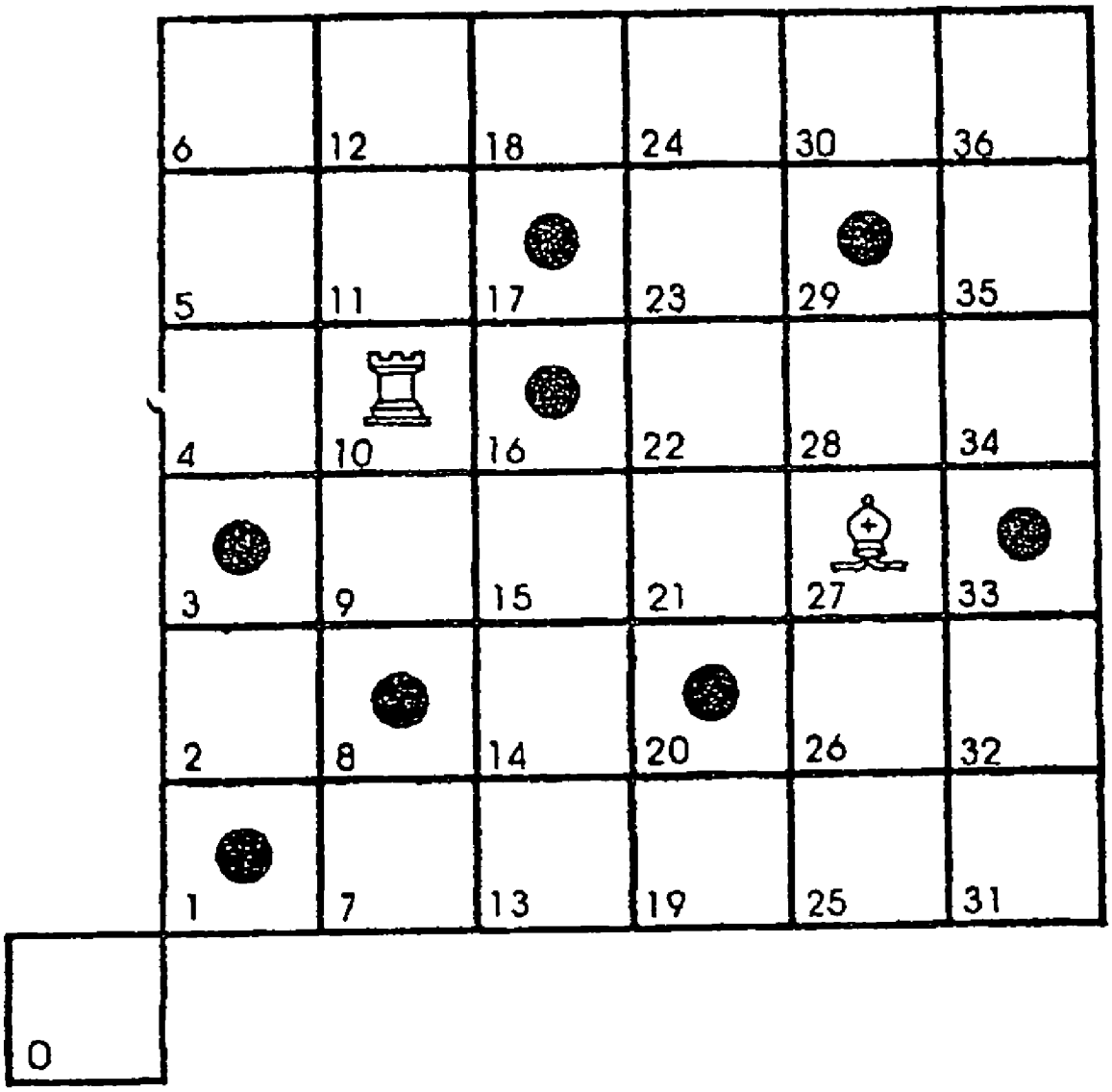

Each player (1-4) places two bets. Two numbers are drawn to denote the cells to which the rook and the bishop will move. The rook can move only vertically, and the bishop can move diagonally. If the betting chip is in the same column as the rook or the same diagonal as the bishop, the player wins (in FIG. 16 these are the chips on cells 8, 16, 17 and 20). If the chip is on the identical number as the rook or the bishop, the player of course wins. 0=37, that is, it functions as any other number. The player determines the size of the bet.

King-knight-two pawn roulette (example 15)

Figure 17:
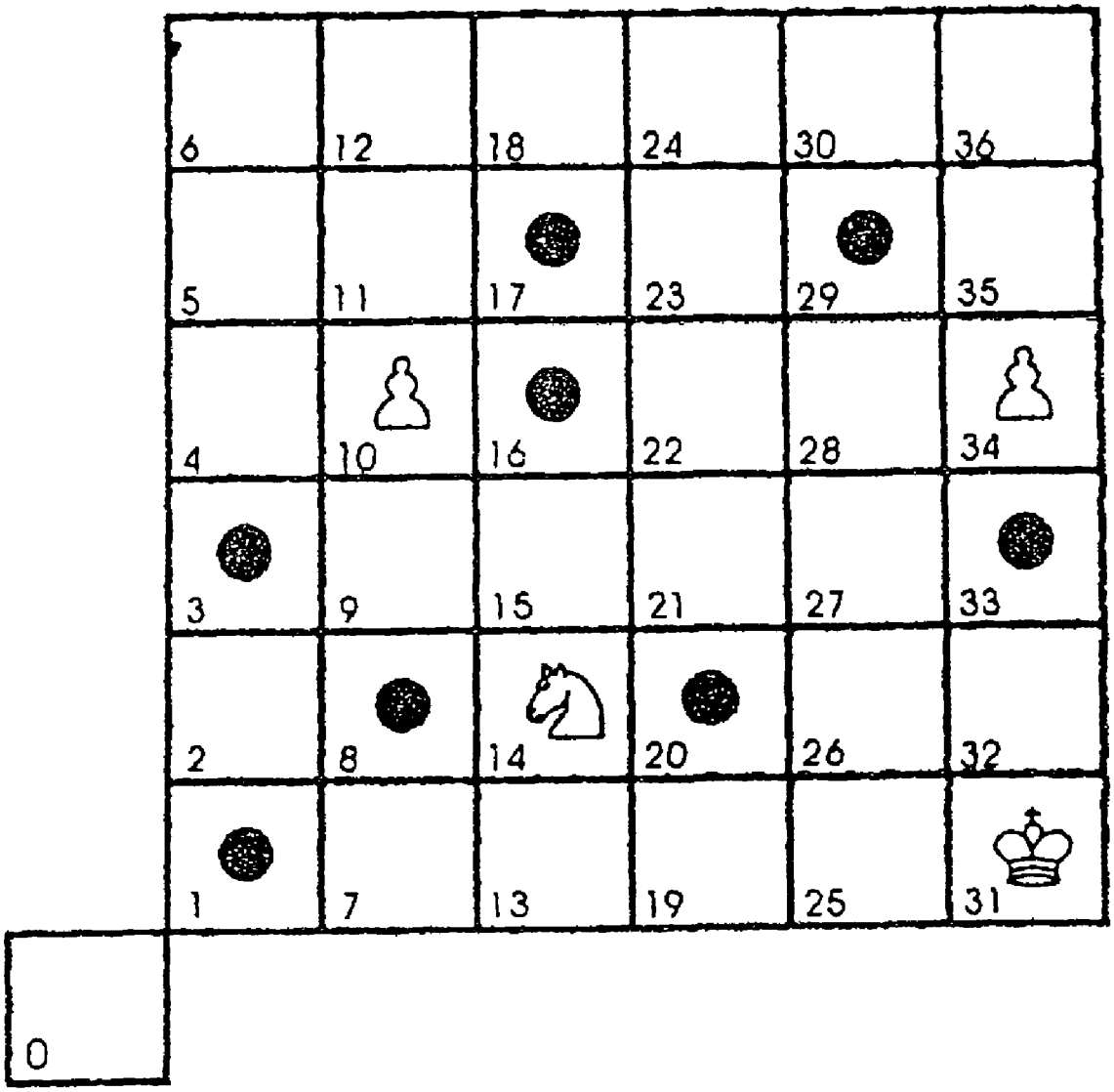

Each player (1-4) places two bets. The places of the king, knight and two pawns are chosen by draw. The king can move to any adjacent cells, the knight jumps as in chess, while the pawns move forward vertically and capture diagonally. If the betting chip can be captured the player wins (in FIG. 17 these are the chips on cells 3, 17 and 29). If the chip is on the identical cell as any of the pieces, the player also of course wins. 0=37, that is, it functions as any other number. The player determines the size of the bet.

Lotto (example 16)

The game can be played by two to four persons, or by one person using chips of four different colors. Each player must place bets on 7 numbers. The players can choose the size of their bets. Seven different numbers are drawn using a roulette cylinder. The amount of the winnings depends on how many numbers are found out of the seven. The relative amounts of the winnings are illustrated in the table below.

| Number found | Winnings |
|---|---|
| 0 | Gets back the amount of the bet |
| 1 | Loses |
| 2 | Loses |
| 3 | Gets back double the bet placed. |
| 4 | Gets back the bet placed + 5 times the bet. |
| 5 | Gets back the bet placed + 100 times the bet. |
| 6 | Gets back the bet placed + 5,000 times the bet. |
| 7 | Gets back the bet placed + 100,000 times the bet. |

Figure 18:
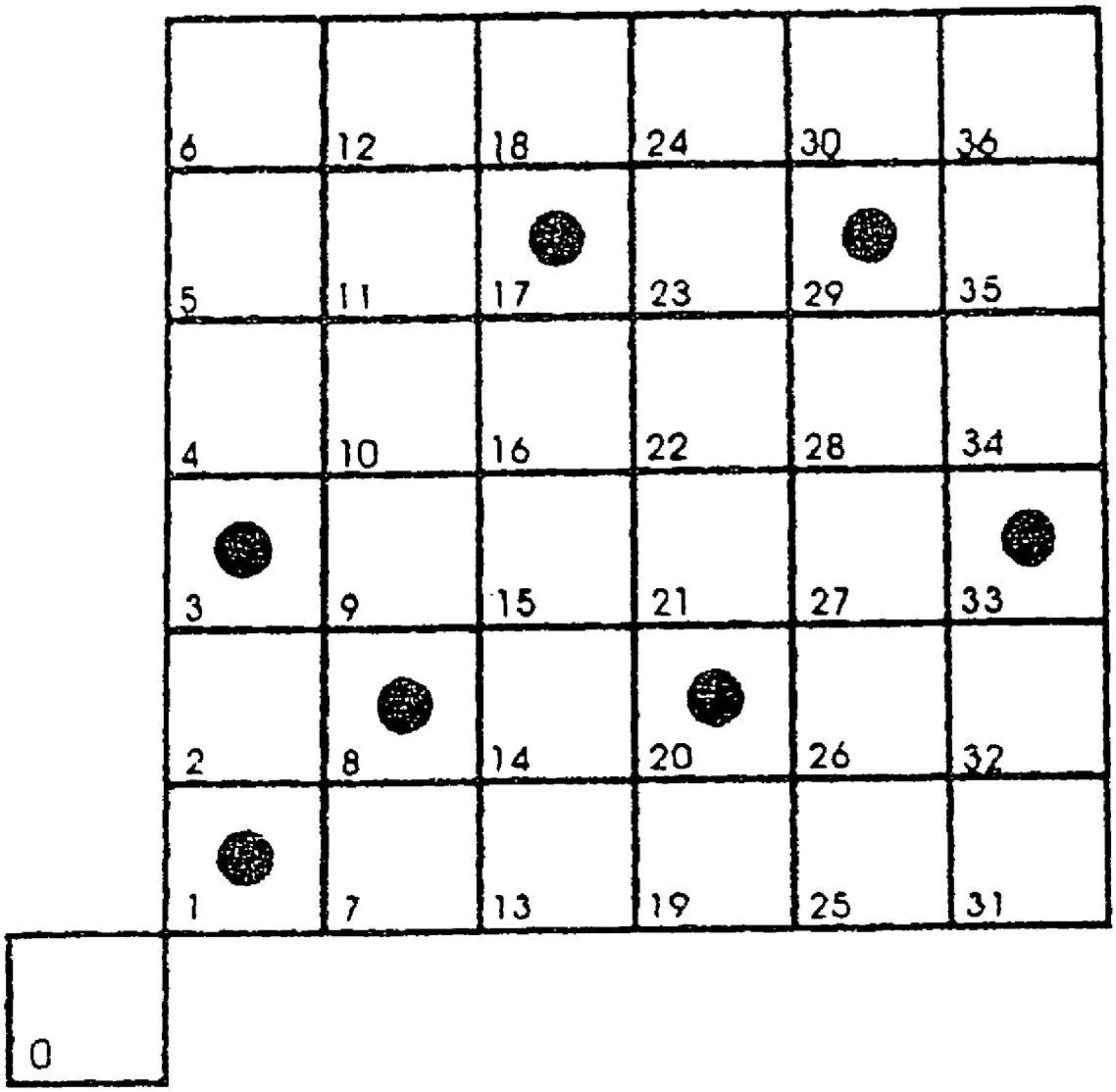

Example: The player placed chips on the following cells: 1, 3, 8, 17, 20, 29 and 33, as shown in FIG. 18. The numbers drawn using the roulette cylinder are 4, 9, 15, 27, 28, 32 and 35. In this case the player has no winning bets. He or she gets back the amount of their bet, for example 30 units.

Lotto chess (TV- and casino versions) (Example 17)

The position of the black and white major pieces on the baseline is randomly generated by a computer. The selection can also be made using a special throwing die. The die features one image of a major piece on each side (the sixth side being 0). When using the die for selection the selected major pieces must be placed in a row from left to right. In the event that the die shows a piece that has already been placed on the board, it must be thrown again.

In the case of a television game, the game begins with a certain amount of money, then it is double or nothing until the player on the telephone (or in the studio) is willing to play. The time of the chess game is limited (in the case of telephone calls to no more than 2 or 3 minutes). In any event, the challenger plays with the white pieces. His or her opponent is a computer (but may also be a person). The challengers in the TV version cannot lose money. In the casino version, however, they can. Of course, this can also be televised. The pieces move according to the rules of Polgár Superstar® 6×6 chess. The game may also involve elements of logic.

Roulette (example 18)

Figure 19:
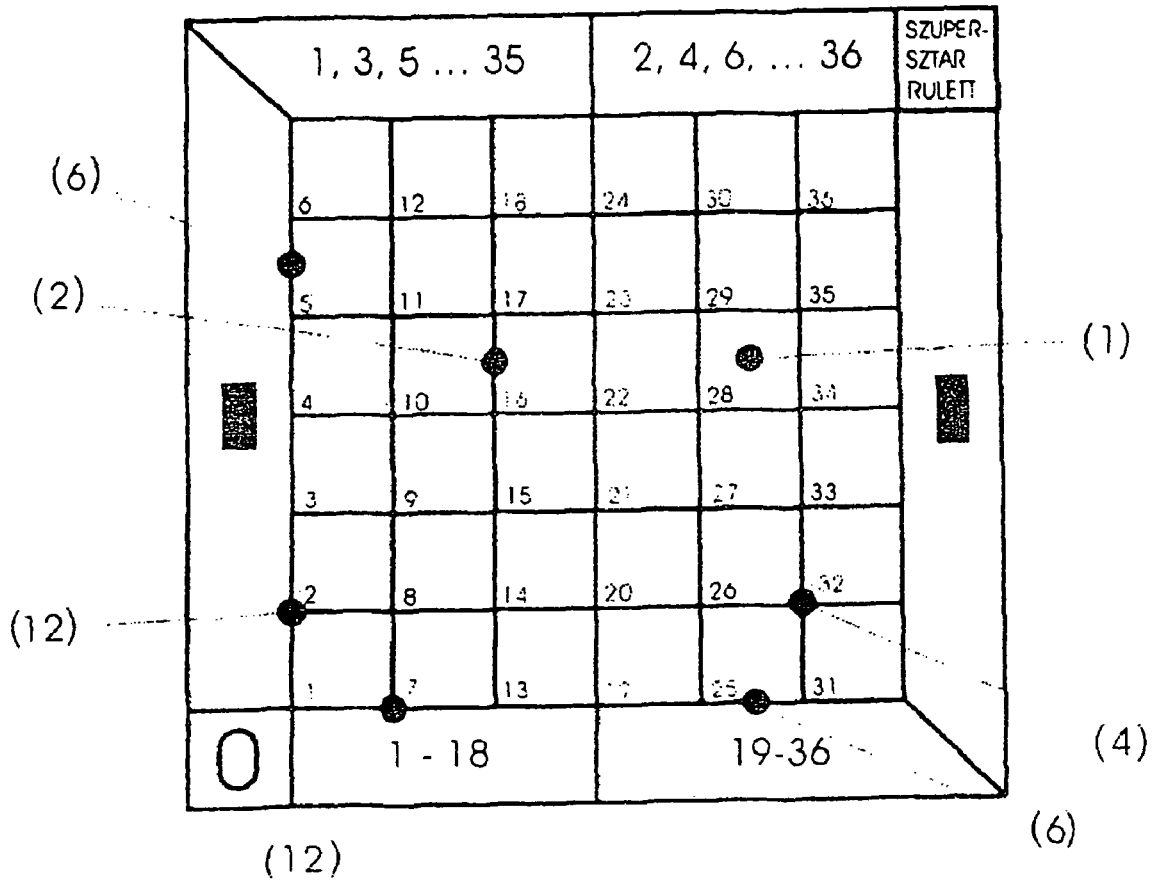

The betting and winning opportunities in this game, represented in FIG. 19, are as follows:

| | |
|---|---|
| Multiple possibilities | |
| a) one whole number | 35× |
| b) two adjacent numbers | 17× |
| c) four adjacent numbers | 8× |
| b) six adjacent numbers | 5× |
| e) twelve adjacent numbers | 2× |
| Simple possibilities | |
| f) all even numbers | 1× |
| g) all odd numbers | 1× |
| h) all red numbers | 1× |
| i) all black numbers | 1× |
| j) 1-18 | 1× |
| k) 19-36 | 1× |

If 0 and 00 win, they must be considered whole numbers, if they lose, the bank wins everything.

Dreidel (example 19)

Bets must be placed in the bank. (According to the agreement of the players—the bets can be sweets, nuts or money). If the bank becomes empty it must be filled, if the players wish to continue the game. If the bank is not divisible without a remainder, the remainder stays in the bank. The game is played with a die numbered 1, 2, 3, 10, 20 and 30, or numbers can be drawn mechanically. Each player moves forward with one piece. If a player throws a number that would take him or her beyond cell 36, they must complete the move via cell 1. For example, if a player is on cell 31 and throws a 20, then the piece must end up on cell 15. (31+20−36=15).

When moving forward 1, 2, 3, 10, 20 or 30 cells, if a piece ends up on a red cell the player must put into the bank an amount corresponding to the number of cells moved. If a piece lands on a black cell the player wins the corresponding amount.

Blackjack (example 20)

The players put deposits in the bank that, according to the agreement of the players, can be sweets, nuts or coins. The game is played with a die numbered 1, 2, 3, 10, 20 and 30, or numbers can be drawn by a computer. Each player has one piece. Pieces move forward the number of cells shown on one throw of the die.

Aim: to reach or get near cell 36. If a player goes beyond cell number 7, the player must decide whether he or she wishes to make a move. A player who goes beyond cell 36 loses. The winning player is the one whose piece reaches cell 36, or whose piece reaches the highest numbered cell before 36. If a player whose piece was behind overtakes the others (from cell 8), the other players can take a further risk by throwing again. If several players land on the same winning cell and no one wishes to thrown again, the game ends in a draw. If the players then wish to carry on playing, they must begin again from 1, or, if they do not wish to continue playing, the bets in the bank are divided by the winners in equal proportions. The players place equal bets and the winner takes all.

Figure 20:
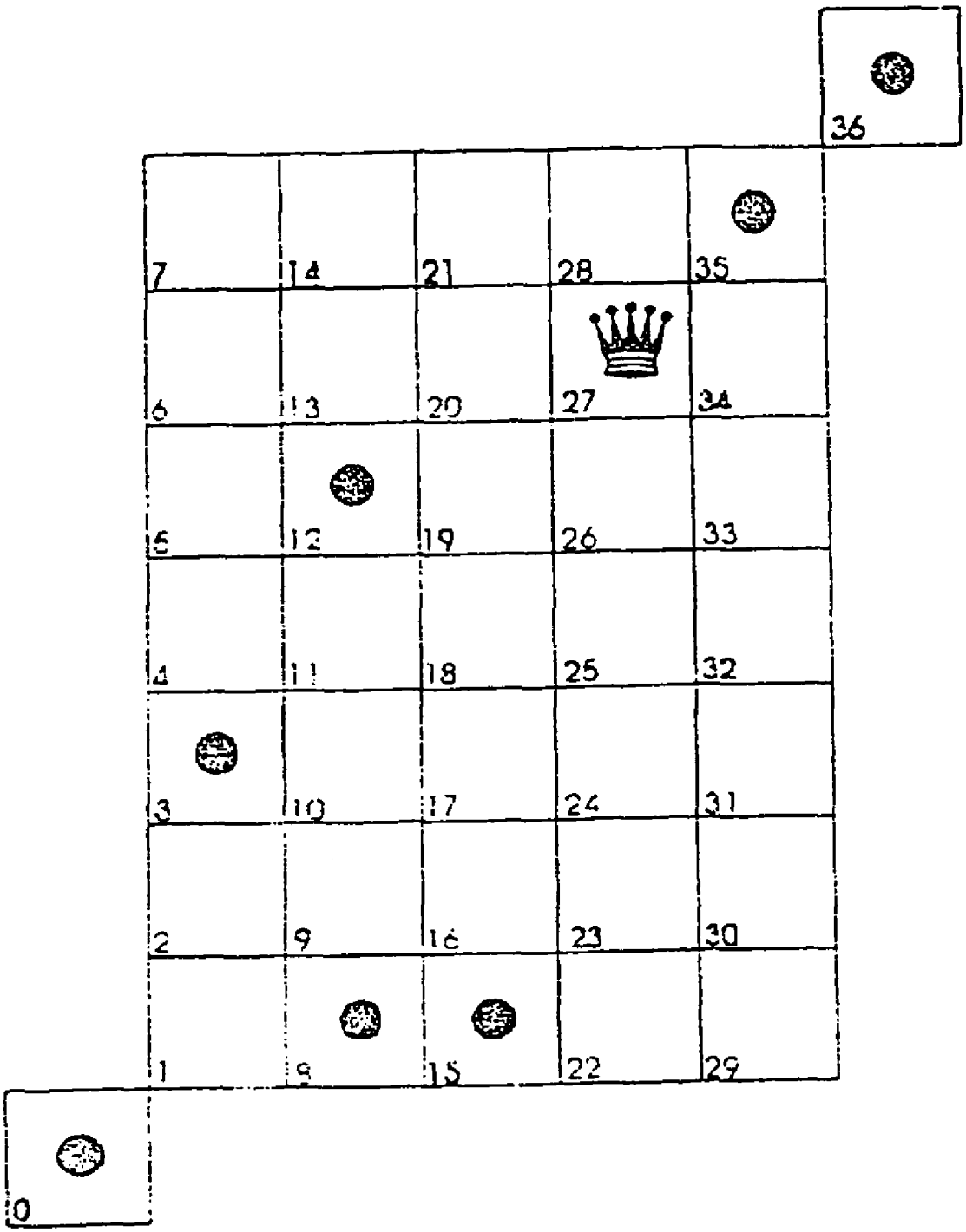
Figure 21:
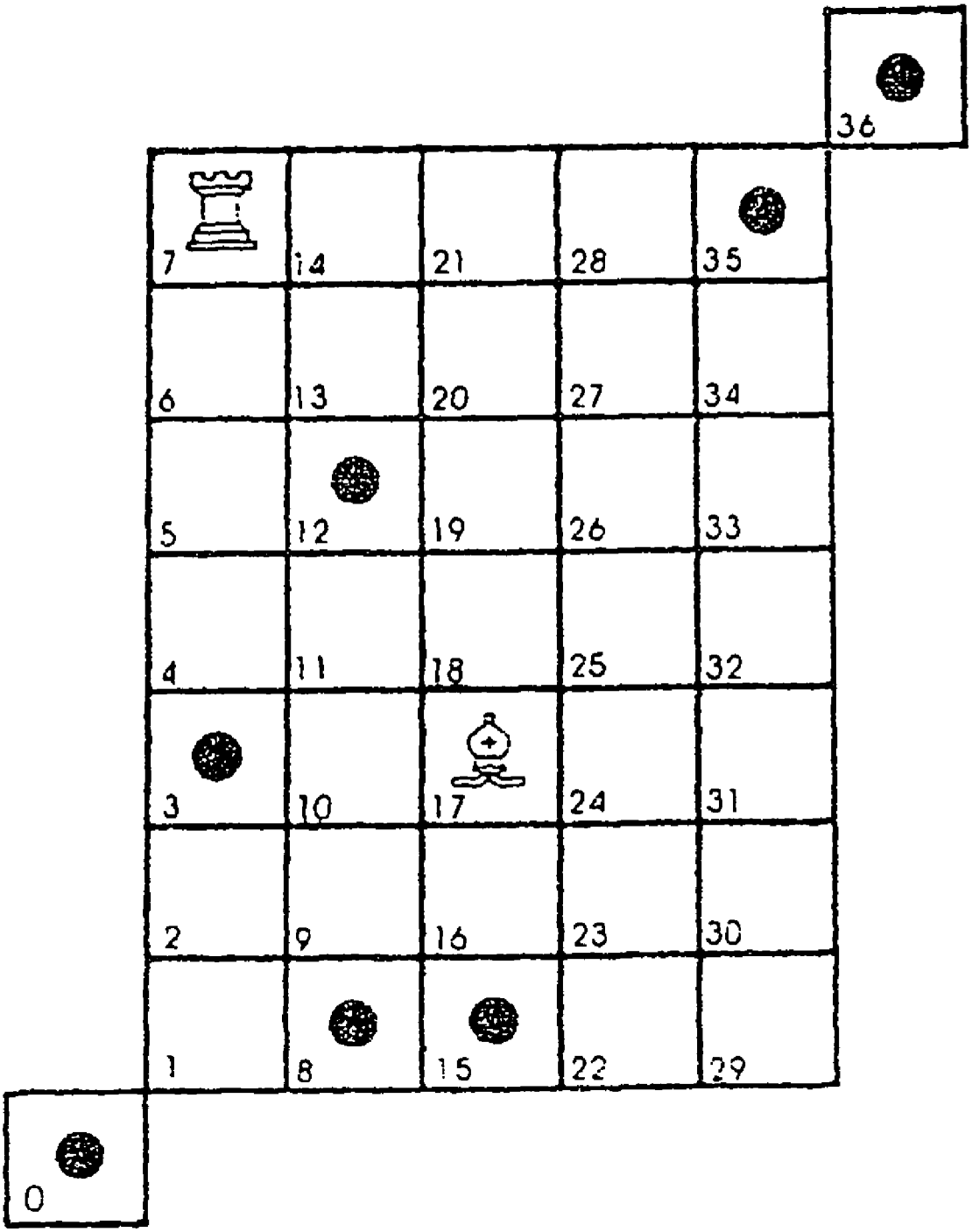
Figure 22:
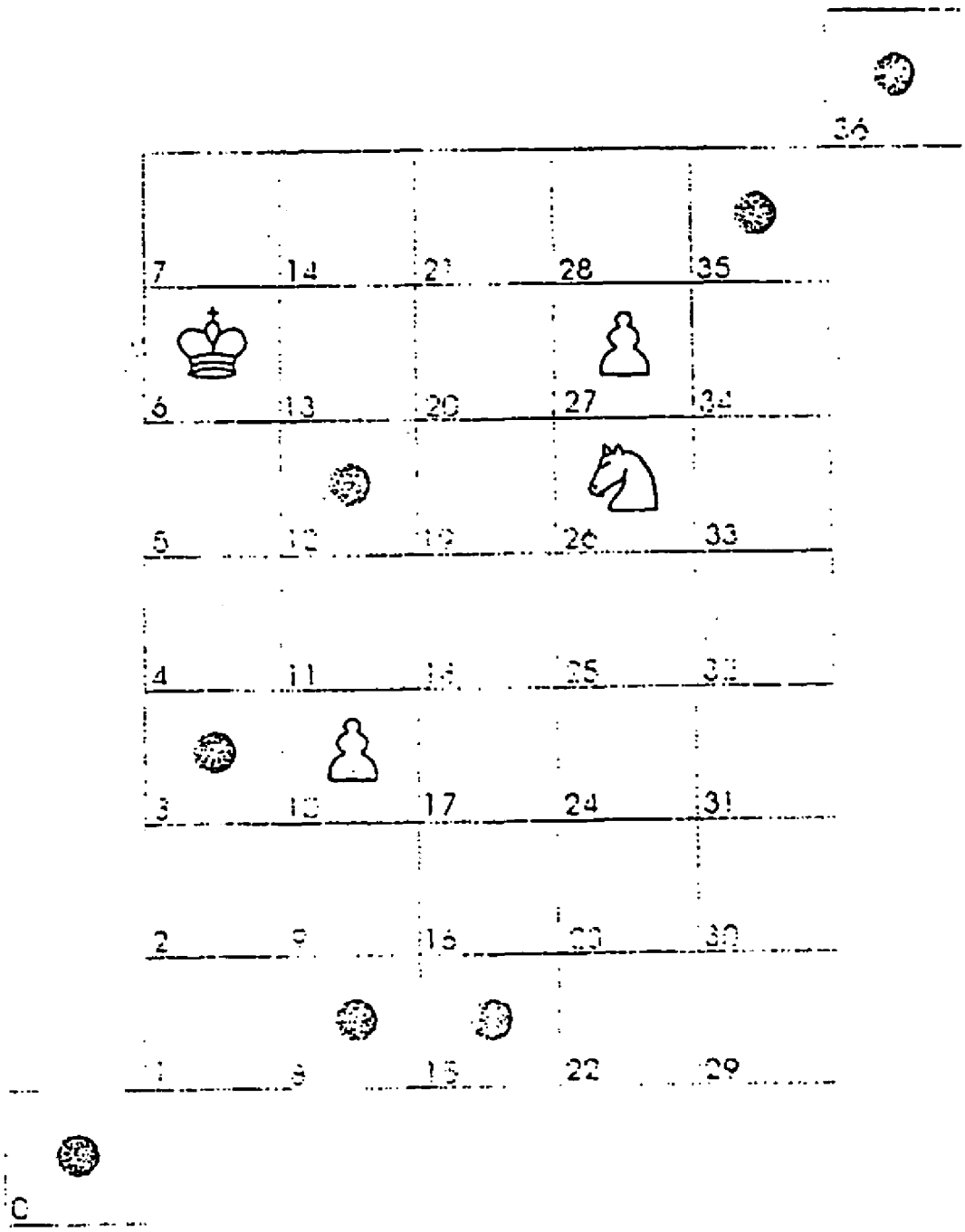
Figure 23:
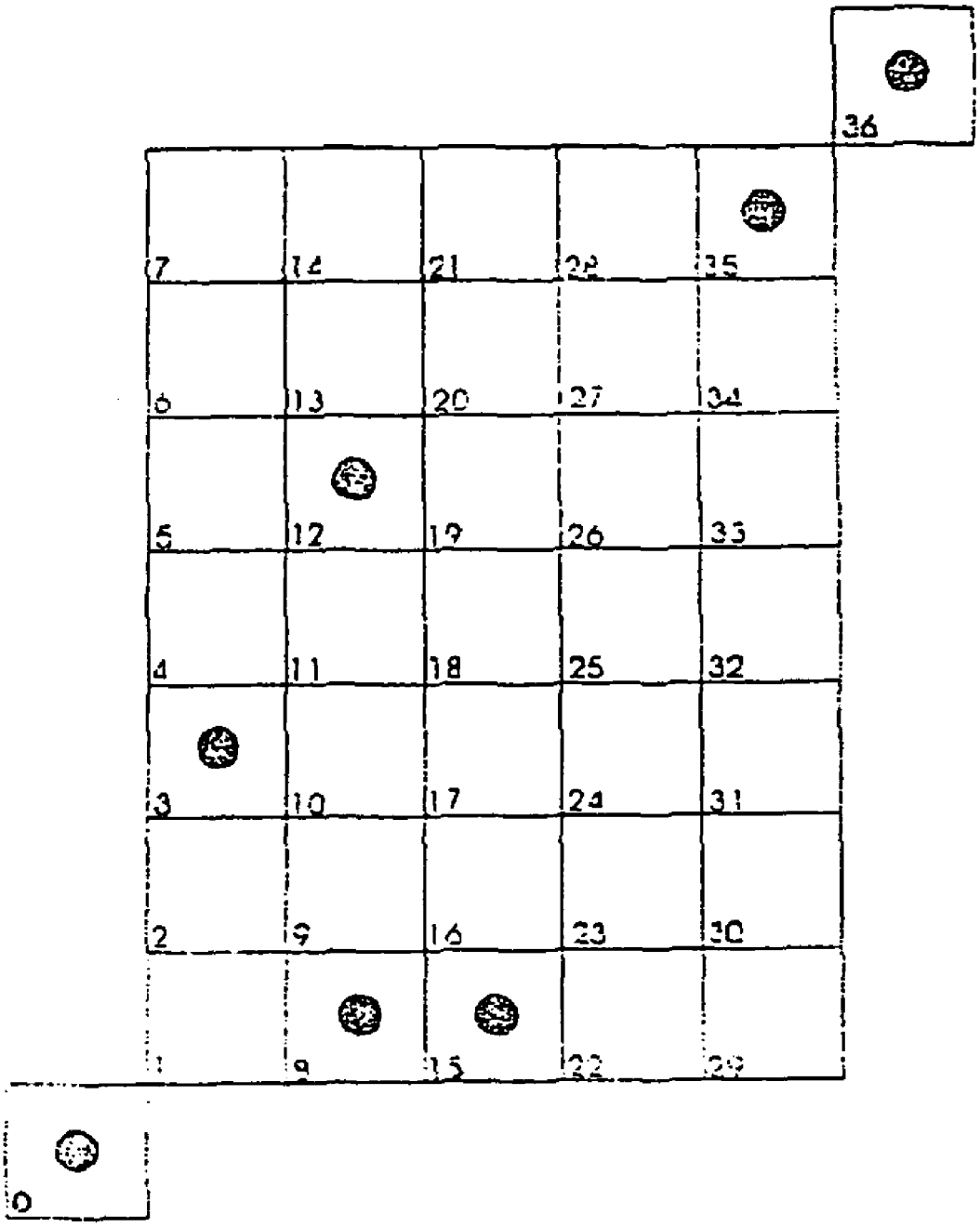
Figure 24:
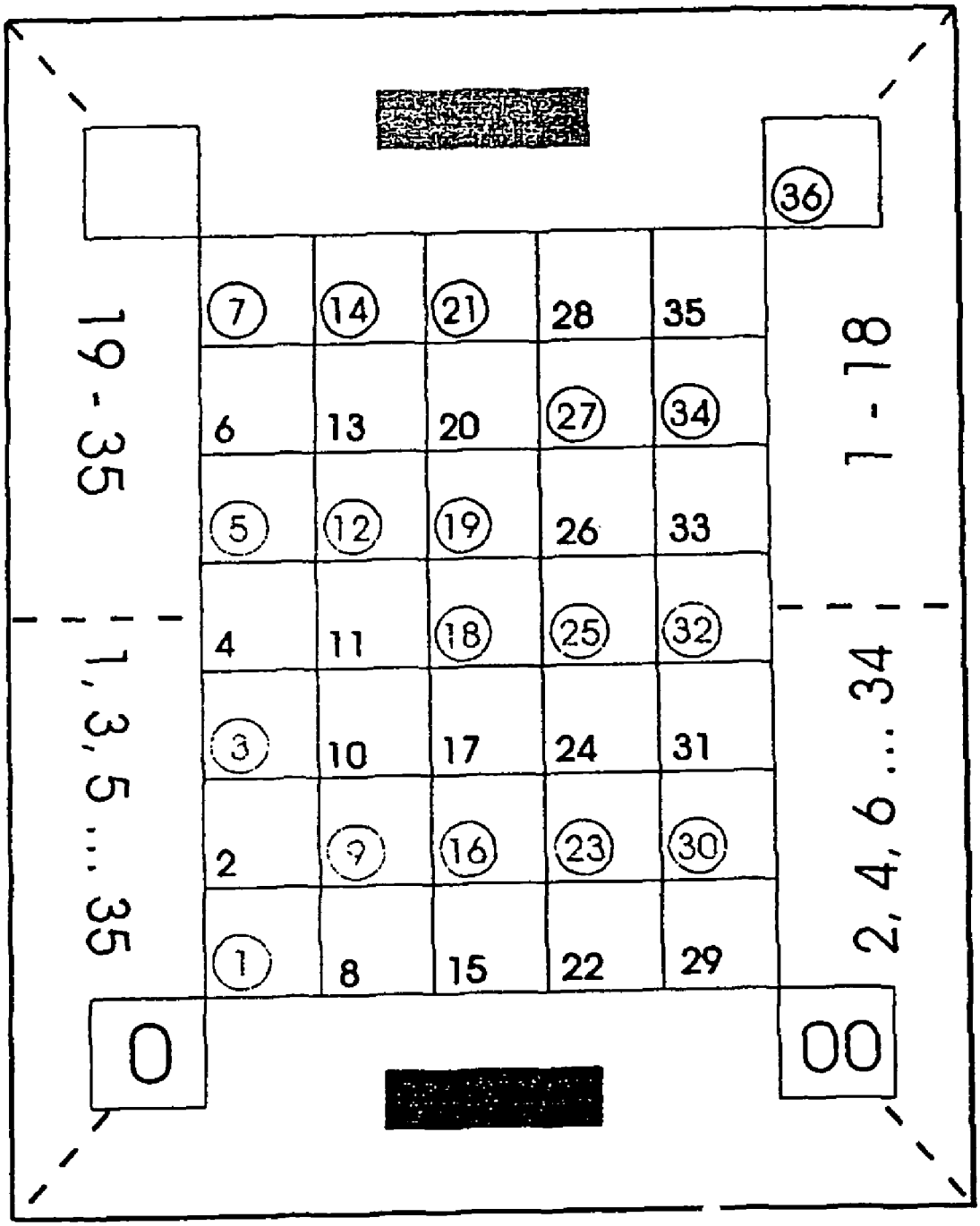

In Polgár Superstar® 5×7 chess, complete with cells numbered 0, 00 and 36 there are altogether 38 fields. Positioned on opposite sides, cells 0, 00 and 36 are special cells, which On the Polgár Superstar® 5×7 board, the same invented games can be played as those which I have demonstrated above for the 6×6 board, FIG. 20 shows the playing area set out for (chess) queen roulette, FIG. 21 shows the playing area set out for rook-bishop roulette, FIG. 22 shows the playing area set out for king-knight-two pawn roulette, FIG. 23 shows the playing area set out for lotto, FIG. 24 shows the playing area set out for roulette.

(Chess-) Queen roulette (example 21)

Each player (1-4) places two bets. A number is drawn to which the queen will be placed. The chess queen can move diagonally as well as vertically. If the betting chip is in the same diagonal or column as the chess queen, the player wins. If the chip is on the identical number as the queen, the player of course wins. 0=37, that is, it functions as any other number. The player determines the size of the bet.

For example: The players place bets on cells 0, 3, 8, 12, 15, 35 and 36; the queen is drawn to 27, as shown in FIG. 20. Bets placed on cells 3, 35 and 36 are won, while chips placed on cells 0, 8, 12 and 15 are lost.

Rook-bishop roulette (example 22)

Each player (1-4) places two bets. Two numbers are drawn, indicating the cells to which the rook and the bishop will move. The rook can move only vertically, and the bishop can move diagonally. If the betting chip is in the same column as the rook or the same diagonal as the bishop, the player wins. If the chip is on the identical number as the rook or the bishop, the player of course wins. 0=37, that is, it functions as any other number. The player determines the size of the bet.

For example: Players placed bets on cells 0, 3, 8, 12, 15, 35 and 36. The rook was placed on cell 7 and the bishop on cell 17, as shown in FIG. 21. Chips placed on cells 1, 3 and 35 are winning bets. Bets placed on cells 8, 12, 15 and 36 are lost.

In the case of a winning chip, the player receives double the bet placed, while in the case of a losing chip, the amount of the bet is lost.

King-knight-two pawn roulette (example 23)

Each player (1-4) places two bets. Four numbers must be drawn to which the king, the knight, and the two pawns will move. The king can move to any adjacent cell, the knight jumps as in chess, while the pawns move forward in the vertical columns and capture diagonally. If the betting chip is on any of the cells adjacent to the king, or can be captured by the knight or the pawns, the player wins. If the chip is on the identical number as any of the pieces, the player also of course wins. 0 and 37 function as any other number. The player determines the size of the bet.

For example: Players placed bets on cells 0, 3, 8, 12, 15, 35 and 36. The knight was drawn to cell 26, the king to cell 6 and the pawns to cells 10 and 27, as shown in FIG. 22. Bets placed on cells 12 and 35 are winning bets, while chips placed on cells 0, 3, 8, 15 and 36 are lost. In the case of a winning chip, the player receives double the bet placed, while in the case of a losing chip, the betting chip is lost.

Lotto (example 24)

The game can be played by two to four persons, or by one person using chips of four different colours. Each player must place bets on seven numbers. The players can choose the size of their bets. Seven different numbers are drawn using a roulette cylinder. The amount of the winnings depends on how many numbers are correct of the seven. The relative amounts of the winnings are illustrated in the table below.

| Number found | Winnings |
|---|---|
| 0 | Gets back the amount of the bet |
| 1 | Loses |
| 2 | Loses |
| 3 | Gets back double the bet placed. |

-continued

| Number found | Winnings |
|---|---|
| 4 | Gets back the bet placed + 5 times the bet. |
| 5 | Gets back the bet placed + 100 times the bet. |
| 6 | Gets back the bet placed + 5,000 times the bet. |
| 7 | Gets back the bet placed + 100,000 times the bet. |

Example: The player placed chips on the following cells: 0, 3, 8, 12, 15, 35 and 36, as shown in FIG. 23. The numbers drawn using the roulette cylinder are 6, 9, 15, 27, 28, 32 and 33. In this case the player has one correct number and loses the betting chip.

Lotto chess (TV and casino versions) (example 25)

The position of the black and white major pieces on the baseline is randomly generated by computer. The selection can also be made using a special throwing die. The die features one image of a major piece on each side (the sixth side being 0). When using the die for selection the selected major pieces must be placed in a row from left to right. In the event that the die shows a piece that has already been placed on the board, it must be thrown again.

In the case of a television game, the game begins with a certain amount of money, then it is double or nothing until the player on the telephone (or in the studio) is willing to play. The duration of the game is limited (in the case of telephone calls to no more than 2 or 3 minutes). In any event, the challenger plays with the white pieces. His or her opponent is a computer (but may also be a person). The challengers in the TV version cannot lose money. In the casino version, however, they can. Of course, this can also be televised. The pieces move according to the rules of Polgár Superstar® 5×7 chess. The game may also involve elements of logic.

Roulette (example 26)

The betting and winning opportunities in this game, represented in FIG. 20, are as follows:

| | |
|---|---|
| Multiple possibilities: | |
| a) one whole number | 35 × the bet |
| b) two adjacent numbers | 17 × the bet |
| c) four adjacent numbers | 8 × the bet |
| d) rows: five adjacent numbers | 6 × the bet |
| e) column: seven adjacent numbers | 4 × the bet |
| f) two diagonal lines: ten adjacent numbers | 3 × the bet |
| g) two columns: fourteen adjacent numbers | 2 × the bet |
| Simple possibilities: | |
| h) all red numbers | 1× |
| i) all black numbers | 1× |
| j) all even numbers | 1× |
| k) all odd numbers | 1× |
| l) numbers 1-18 | 1× |
| m) numbers 19-36 | 1× |

0 and 00 are to be regarded as whole numbers, 37=0 loses, the bank wins everything. FIG. 24 shows the game board with winning possibilities.

My invention is worked out for dreidel and blackjack on the Polgár Szupersztár® 5×7 board, complete with cells 0 and 00, as follows:

Dreidel (example 27)

Bets must be placed in the bank. (According to the agreement of the players the bets can be sweets, nuts or money). If the bank becomes empty it must be filled, if the players wish to continue the game. If the bank is not divisible without a remainder, the remainder stays in the bank. The game is played with a die numbered 1, 2, 3, 10, 20 and 30, or numbers can be drawn by computer. The aim of the game is to reach or approach cell number 35. Each player moves forward with one piece. If a player throws a number that would take him or her beyond cell 35, they must complete the move via cell 1. For example, if a player is on cell 31 and throws a 20, then the piece must end up on cell 16. (31+20-35=16).

When moving forward 1, 2, 3, 10, 20 or 30 cells, if a piece ends up on a red cell the player must put into the bank an amount corresponding to the number of cells moved. If a piece lands on a black cell the player wins the corresponding amount.

Blackjack (example 28)

The players put deposits in the bank that, according to the agreement of the players, can be sweets, nuts or coins. The game is played with a die numbered 1, 2, 3, 10, 20 and 30, or numbers may be drawn by computer. Each player has one piece. Pieces move forward the number of cells shown on one throw of the die.

The aim of the game is to reach or approach cell number 35. If a player goes beyond cell number 6, the player must decide whether he or she wishes to make a move. A player who goes beyond cell 35 loses. The winning player is the one whose piece reaches cell 35, or whose piece reaches the highest numbered cell before 35. If a player whose piece was behind overtakes the others (from cell 7), the other players can take a further risk by throwing again. If several players land on the same winning cell and no one wishes to thrown again, the game ends in a draw. If the players then wish to carry on playing, they must begin again from cell 1, or, if they do not wish to continue playing, the bets in the bank are divided by the winners in equal proportions. The players place equal bets and the winner takes all.

In order to play and teach the invented games computer experts have developed programs, in keeping with the instructions of the inventor. These playing and teaching programs have been carefully tested by the inventor. The programs are being continuously developed, and users' manuals and guides are being compiled. The computer programs and users' guides that have been developed for playing and teaching the invented games are the property of Dr. László Polgár. In the course of the patenting process, the inventor will, on request, submit these programs and/or users' guides to the Patent Office. The above-mentioned computer programs are protected by copyright (©).

In the modern world, time, money and the avoidance of long absences from home and long-term stress are all very important. Stress is a factor not only during individual games but also throughout the entire two or three weeks of a chess tournament. Experience shows that in the case of reform chess, competitions can be completed in one or two days, which is a distinct advantage when it comes to organizing chess tournaments, and this advantage will be perfectly illustrated in Polgár Superstar® reform chess competitions. At amateur level, one advantage of my board game inventions is that one can easily find time either to play a game at home, while performing other activities, or while traveling, or to solve a puzzle as a means to mental stimulation and recreation. This game is particularly recommended as a way of occupying one's time on long airplane or train journeys.

As a result, the board games that can be played on the Polgár Superstar® orthogonal reform chess (6×6 and 5×7) boards are particularly suitable for educational purposes, with special respect to developing creativity. Since they are easy and fast to play, they are perfect for televising and also suitable for chess instruction and for competitions and contests. Thrilling live chess demonstrations can be staged in theatres or in the open air. Experience has shown that Polgár Superstar® orthogonal reform chess is easier to teach, to learn and to play than traditional chess. With the development of computer programs this game will open up new horizons in the modern world of chess computers and chess software. Since it is easy to teach and to play, and since the combinative opportunities are far greater than in traditional chess, it provides a unique opportunity for the development of combinative abilities and creativity. The game is more interesting and entertaining than traditional chess, and can even be televised live in the form of game displays, test matches, puzzle competitions, and so-called four-handed double and mixed-double games. There are excellent opportunities to play the games on the Internet, by telephone, on mobile phones, or against computer software and mini-chess computers, which can easily popularize these modern games.

The above considerations, mutatis mutandis, are also valid for the game-of-chance inventions.

In summary, it can be stated that the board game inventions have many attractive features that can create favorable conditions for the spread of the games, with the expectation of financial success.

ADDITIONAL EMBODIMENTS OF THE PRESENT INVENTION

As shown in FIGS. 25-42, the present invention may be embodied in a multitude of other ways, depending upon the board and specific game selected.

A variety of boards may be used, including a 6×6 square, 5×7 rectangle, or a 37-cell six-pointed star-shaped board (with hexagonal cells). To play roulette on the 6×6 board, in addition to the 36 cells there are 0 and 00 cells, as well as red and black, odd and even, 1 to 18 and 19 to 36 playing areas (this also is the case with the 5×7 board).

The following games can be played on the boards: Chess, Halma, Pyramid, Checkers (Shashki), Horse Race, Pawn War, French Chess, Queen Roulette, Rook-Bishop Roulette, King+Knight30 2 Pawns Roulette, Lottery, Lottery Chess, Roulette, Black Jack and Dreidel.

The games are fast, dynamic, and highly enjoyable. The logical games are also ideal for developing creativity. They are also highly beneficial in the development of other abilities and skills.

In the chess game the major pieces can be positioned on the baseline in any order. Thus on the 6×6 board there are 64,800 different setups, while on the star-shaped board and the 5×7 board there are a total of 7,200 varieties.

The games also may be embodied as computer programs, as well as on-line and television versions.

The advantages of the games of the present invention include:

Faster (fewer cells make for a more dynamic game)

More interesting (more combination of options)

Easy to televise (because of shorter games)

Easy to teach Suitable for any age

Excellent for developing creativity and logical thought

In one of the menus of star chess the game of logic can be connected with the elements of a game of chance. This option makes the game unique among its kind. Of course, these games are more than games. They are a science and an art as well. They are excellent tools for education. They can also be used for both diagnosis and therapy. Feelings of success or failure can also develop the personality.

They can be played on a computer, on the Internet, on a mobile phone and other personal digital assistants and devices.

There are competitions which attract huge interest.

Polgár Superstar Chess 6×6

The starting position.

Square is always black. Black is always at the top, white is always at the bottom. Bishops may move on squares of the same color. The pawns are placed on the second and sixth rows respectively. The players then in turn place one piece anywhere on the starting row (first and rows respectively) until all the pieces are positioned.

Each square can be denoted by a number.

Figure 25:
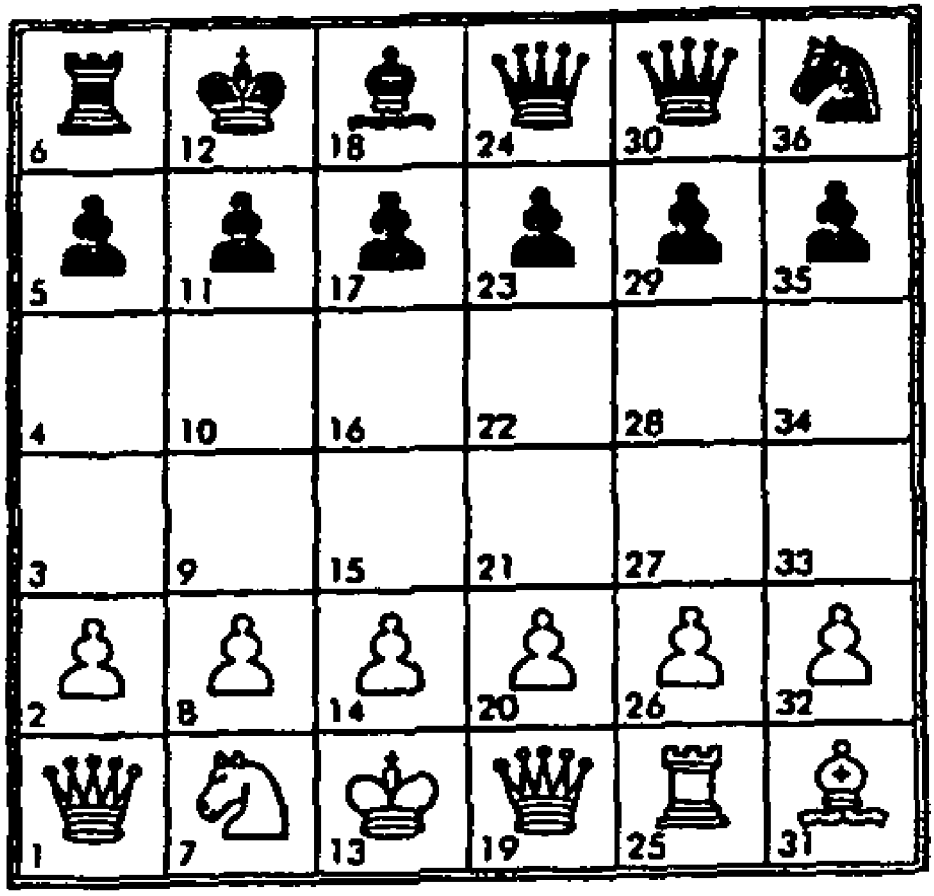

This embodiment is shown in FIG. 25.

The king may move one square in any direction, so long as no piece is blocking its path. The king can capture in any direction.

The king may not move to a square:

occupied by one of his pieces, where it is checked by an enemy piece, adjacent to the enemy king.

Castling is not possible.

Figure 26:
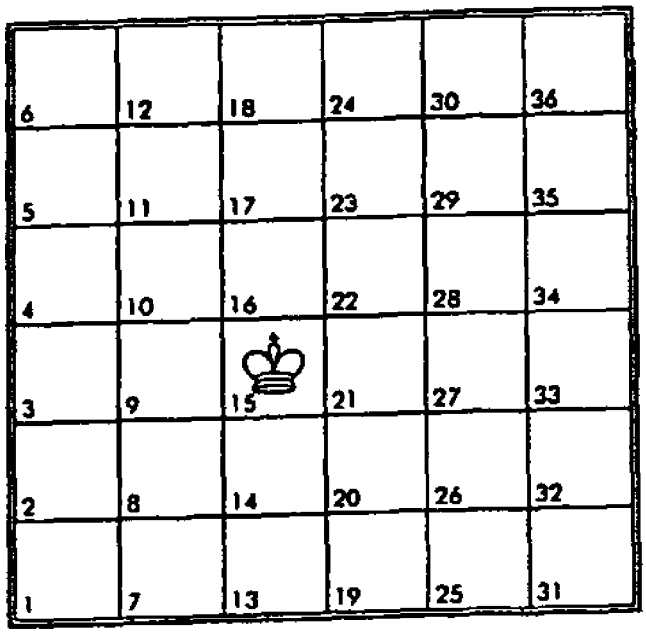

This embodiment is shown in FIG. 26.

The pawn on its first move may move either one or two squares forwards. The pawn after the first move may only advance one square at a time. The pawn captures by moving diagonally one square forwards, either to the left or the right.

The pawn may not move or capture backwards.

If a pawn reaches the last (or first) row of the board, it must be exchanged. There is no en passant in this game. It can be exchanged for a, queen, b, knight, c, bishop, d, rook of its own colour. But never for a king!

If you still have your original queen, you might have a new queen as well. Neither pawn can move (9, 10).

Figure 27A:
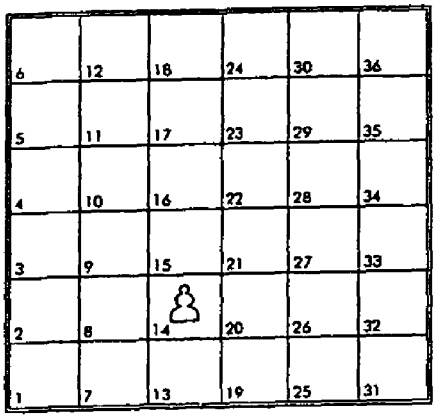
Figure 27B:
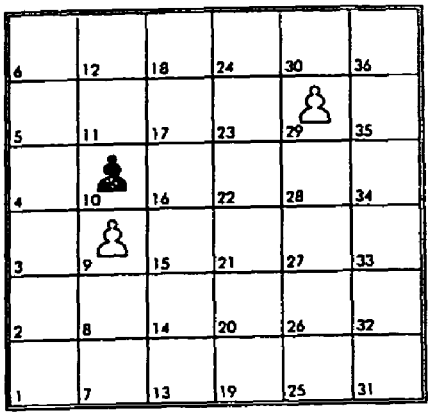

This embodiment is shown in FIGS. 27A and 27B.

The rook may move any number of squares horizontally or vertically, so long as no piece is blocking its path.

The bishop may move any number of squares diagonally, backwards or forwards, so long as no piece is blocking its path.

Figure 28A:
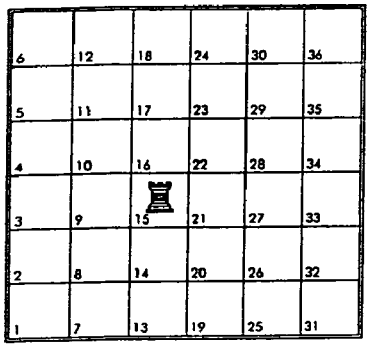
Figure 28B:
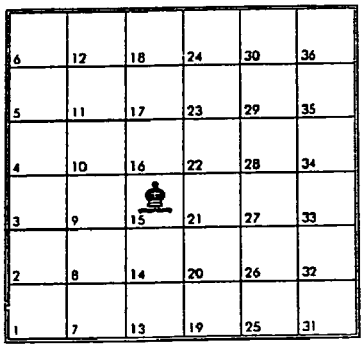

This embodiment is shown in FIGS. 28A and 28B.

The queen may move any number of squares in any direction, so long as no piece is blocking its path. But it cannot move as a knight.

The knight may leap to any square in an "L" shape. It is the only piece which may jump over a piece in its way.

Figure 29A:
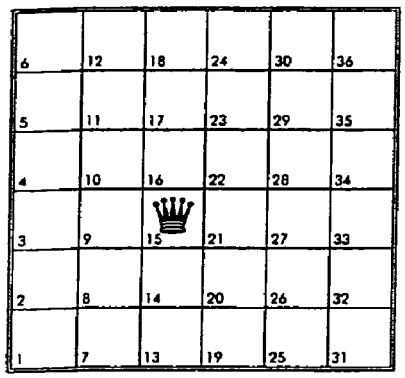
Figure 29B:
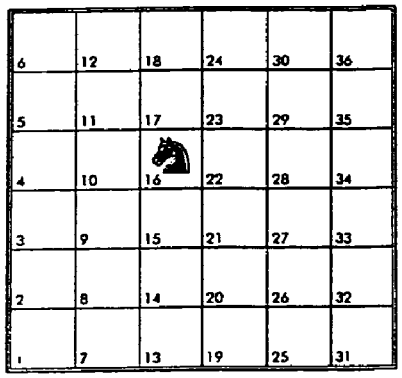

This embodiment is shown in FIGS. 29A and 29B.

A king is in check if it is attacked by an opposing piece. A king can never be captured. If the king cannot move and it is not checkmate, and the player whose turn it is cannot move any other piece, the game ends in a draw by stalemate.

If the king cannot escape from check, this position is checkmate.

Figure 30A:
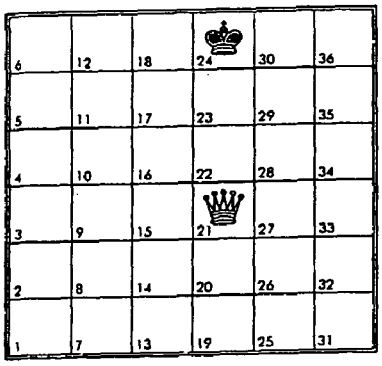
Figure 30B:
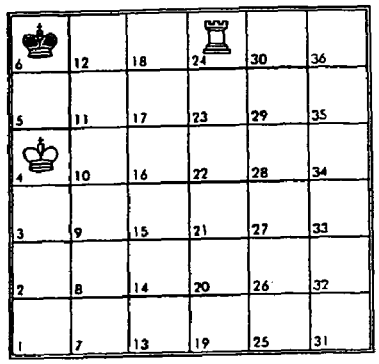
Figure 30C:
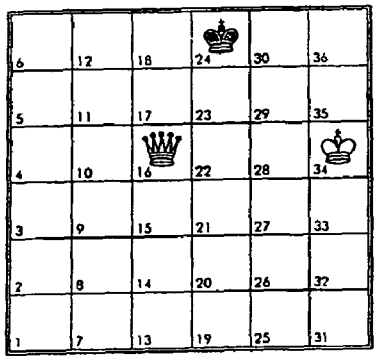

This embodiment is shown in FIGS. 30A, 30B, and 30C.

Move number+symbol of the piece (no symbol for the pawn)+the square the piece travels to. Here: 15-7.

One's cannot capture one's own pieces.

=draw

−+black is winning

+−white is winning

#checkmate

Figure 31:
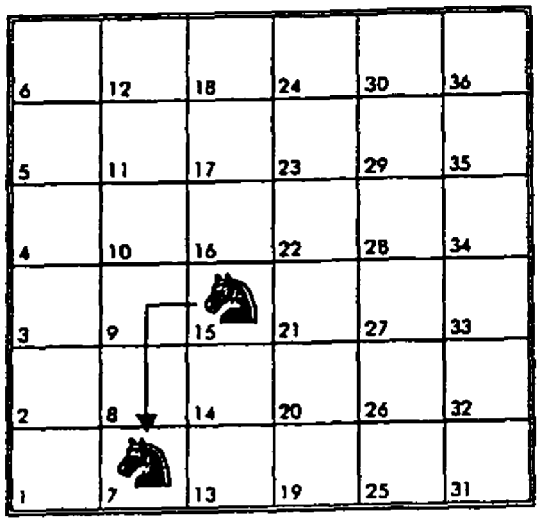

This embodiment is shown in FIG. 31.

Superstar 6×6 Pawn War

In the basic setup there are 2 to 6 pawns, the number decided by agreement or a draw, and 1 king of each color. The kings can be placed anywhere on the board (in front of or behind the pawns). If a player's pawn reaches the opponent's baseline, the pawn must be promoted into a queen, rook, knight or bishop.

Aim: to checkmate the opponent's king The game can also finish in a draw.

One possible setup.

Figure 32:
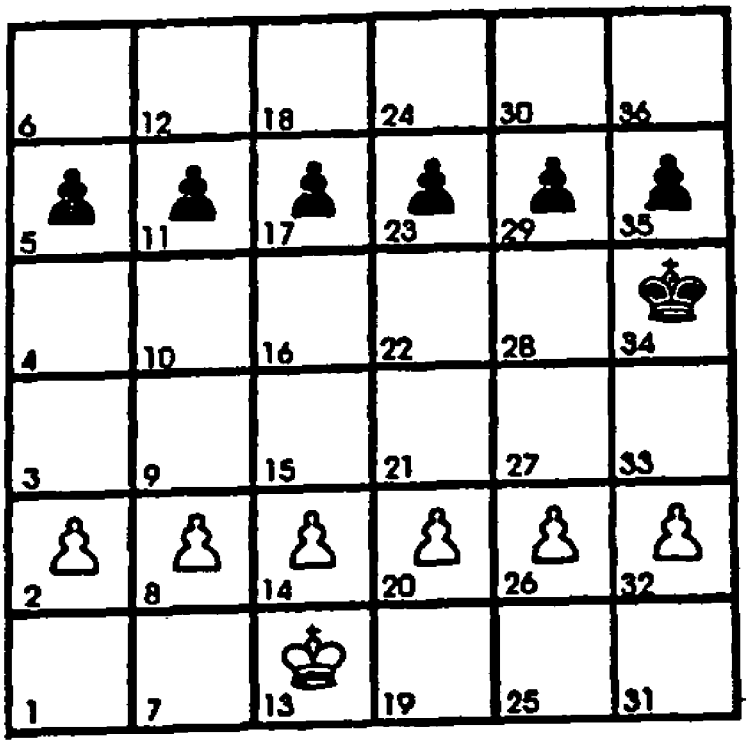

This embodiment is shown in FIG. 32.

1.32-33 29-28 2.33-28 23-28 3.26-27 ♔34-33 4.8-10!! 17-10 (4.-5-10 5.14-16 11-16 6.2-4 1:0) 5 2-4 11-4 6.14-16 ♔33-26 7.16-17 35-33 8.17-18♕ 33-32 9.♕18-16 ♔26-25 10.20-22 32-31♕ 11.♕16-31 ♔25-31 12.22 -23 ♔31-26 13.23-24♕ 1:0

Superstar 6×6 Horse Race

Instead of pieces and pawns, only knights appear on the board. Capturing is possible.

Aim: To take over the opponent's starting position. The winner may not finish with fewer knights on the board.

Figure 33:
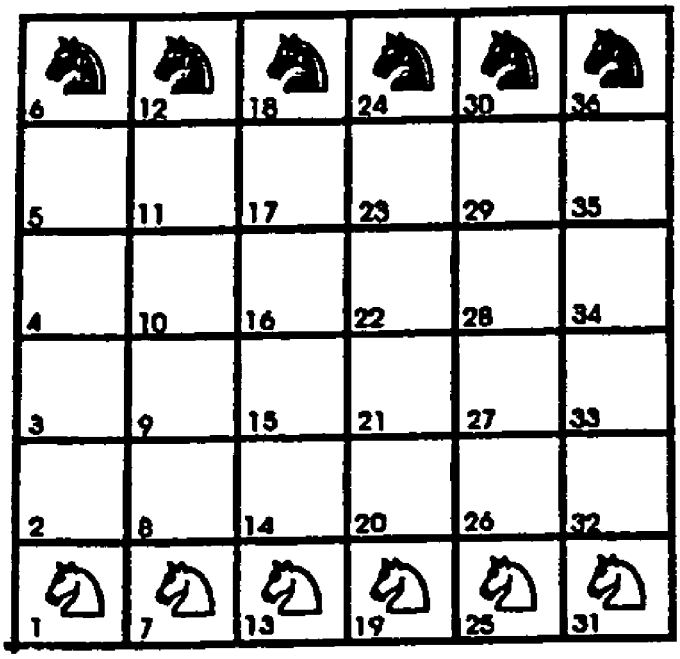

This embodiment is shown in FIG. 33.

1.♘19-27 ♘24-16 2.♘27-16 ♘12-16 3.♘7-20 ♘16-20 4.♘31-20 ♘6-10 5.♘13-21 ♘10-21 6.♘25-21 ♘30-22 7.♘1-9 ♘22-9 8.♘20-9 ♘36-28 9.♘9-17 ♘28-17 10.♘21-17 ♘18-22 11.♘17-6 1:0

Superstar 6×6 French Chess

To start, the players place the major pieces (king, 2 queens, rook, bishop, knight) individually, in alternating order. The pawns are placed in front of the pieces. A player may not capture his or her own pieces, but an opponent's piece that can be captured must be captured. Pawn promotion is possible. Exception: The king can move into check and the king can be captured. If a player cannot move, then the opposing pawns change places, and that counts as a move.

Aim: to have all one's pieces captured. If all a player's pieces are captured, that player wins. If neither player can move, the game ends in a draw. The game also ends in a draw if one side is unable to sacrifice a piece.

Figure 34:
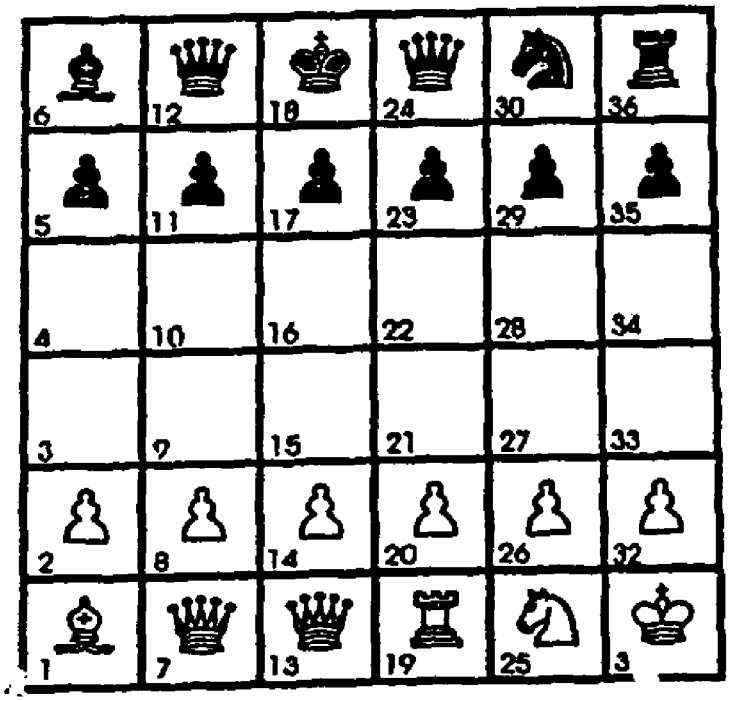

This embodiment is shown in FIG. 34.

1.14-16 11-16 2.♕13-16 ♕12-8 3.♕7-8 ♔6-16 4.♕8-29 ♕16-2 5.♔29-23 6.♕1-36 ♕2-7 7.♖19-7 ♕24-29 8.♕36-29 ♔23-29 9.26-28 35-28 10.32-34 ♔29-34 11.♘25-21 28-21 12.♔31-26 21-26 13.20-22 17-22 14.♖7-10 5-10 1:0

Superstar 6×6 Pyramid

Pieces can move only diagonally. They may move backwards. There is no capturing. Jumping is allowed. Series of jumps are also permitted. Pieces that are jumped over may not be captured.

Aim: to reach the opponent's starting positions. The game is similar to Halma, but pieces may not move vertically or horizontally.

Figure 35:
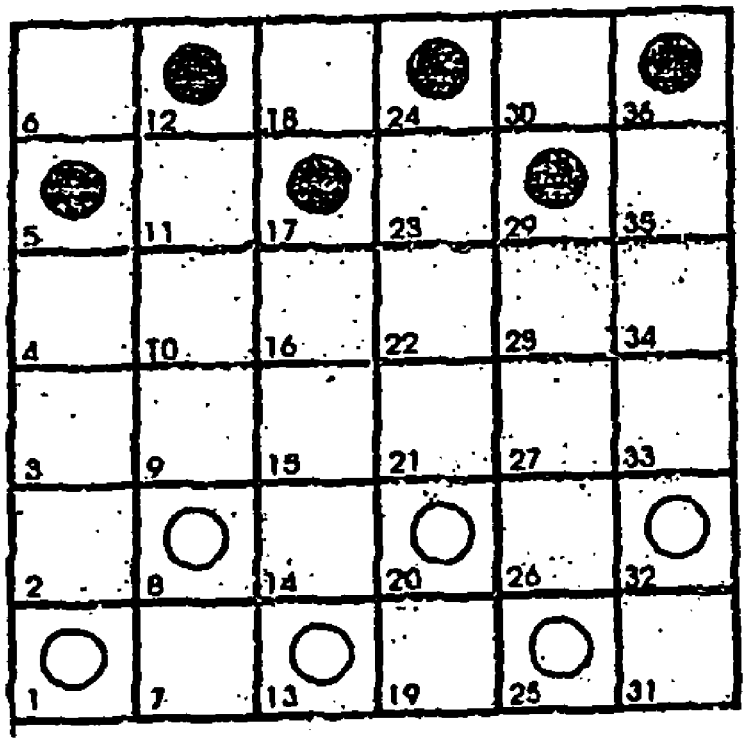

This embodiment is shown in FIG. 35.

1.1-15 12-22 2.20-10 17-3 3.10-17 22-12 4.15-22 29-15-1 5.32-27 5-10 6.27-34 10-15 7.34-29 15-20 8.25-15 20-25 9.15-10 25-32 10.10-5 32-25 11.29-34 36-29 12.22-36 29-22 13.34-29 24-34 14.13-20 34-27 15.20-34-24 22-32 16.8-15 12-22-8 17.15-22 3-13 18.22-12 1:0

Superstar 6×6 Halma

Requires four pieces for each player. The pieces can move vertically, diagonally and horizontally. There is no capturing. Jumping is allowed (as is jumping in series). Pieces may also move backwards. Pieces that are jumped over may not be captured.

Aim: To occupy, by moving diagonally, the starting positions of the opposing pieces. The player who is first to occupy the opponent's cells is the winner. A player must leave his or her own starting cells in seven moves. The game is similar to Pyramid, but here pieces can also move vertically and horizontally.

Figure 36:
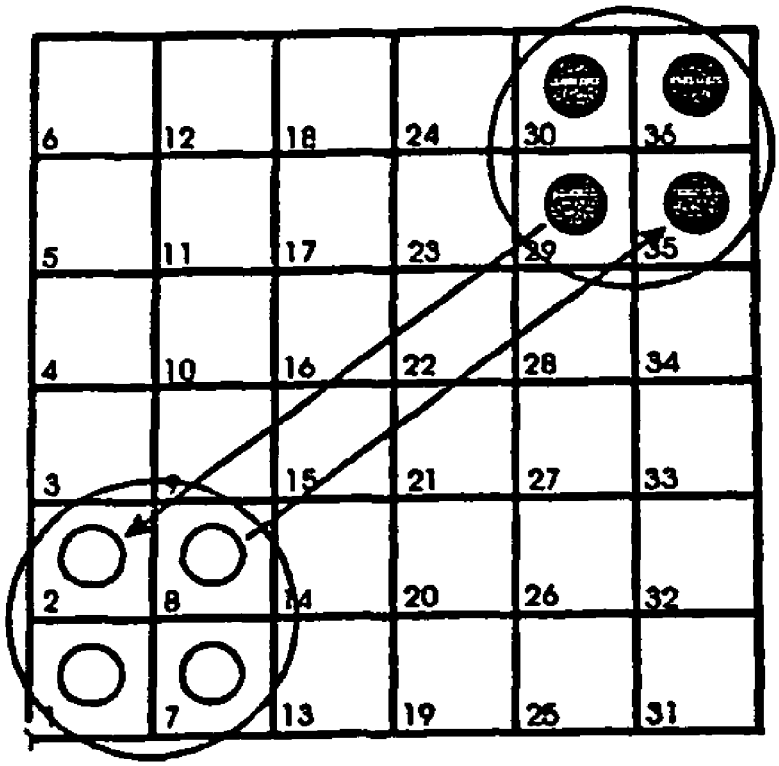

This embodiment is shown in FIG. 36.

1.7-9 30-28 2.1-3 36-34 3.2-16 34-22 4.9-23 29-17-15-1 5.3-9 22-10 6.16-30 35-21 7.9-11 28-14-2 8.11-17 21-14 9.8-20 14-8 10.17-29 10-9 11.20-27 9-7 0:1

Superstar 6×6 Shashki (Checkers)

Each player has 6 pieces. Pieces can move only diagonally. Pieces may not move backwards. Jumping is allowed, and series of jumps are also permitted. If a player jumps over an opponent's piece, the piece or pieces that have been jumped over must be captured. If a player's pieces reach the topmost, or first, row, then the pieces are transformed into queens, which can move and capture diagonally backwards and forwards.

Aim: to capture all the opponent's pieces, or to create a position in which the opponent is unable to move. Similar to Pyramid, but pieces that are jumped over must be captured.

Figure 37:
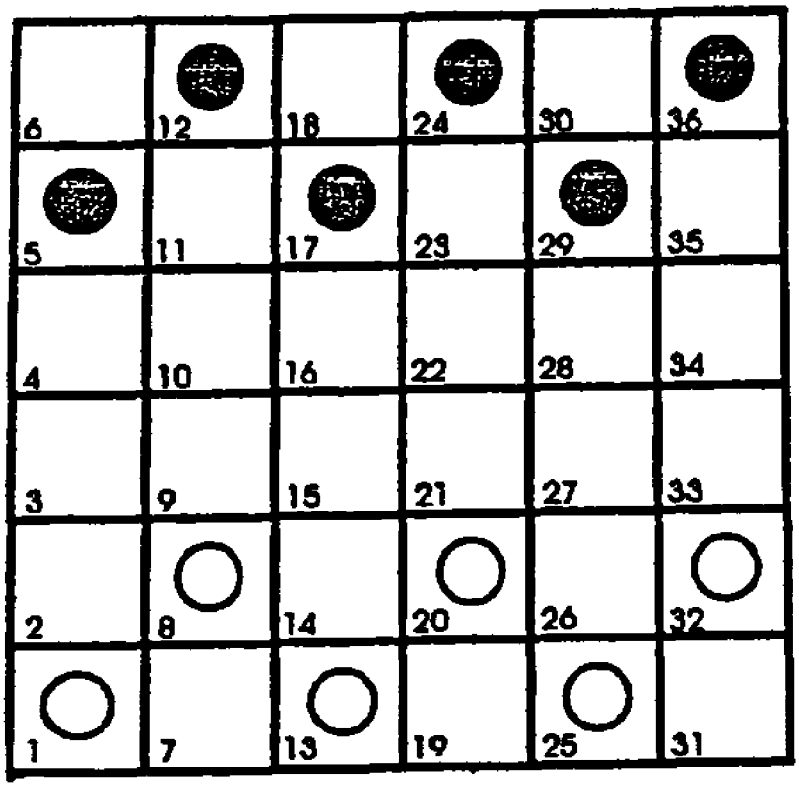

This embodiment is shown in FIG. 37.

1.1-15 29-22 2.15×29 36×22 3.8-15 22×8 4.13×3 17-10 5.3×17 12×22 6.20-27 22-15 7.32-22 15-8 8.25-20 8-1D 9.20-15 5-10 10.15×5 D1×36 11.5-12D 24-17 12.D12×22 D36×8 13.27-34 D8-15 14.34-29 D15×36 0:1

Rook and Bishop Roulette 6×6 Superstar Chess

Each player (1-4) places two bets. A number is drawn. on which the rook and bishop will be placed. The rook can move only vertically, while the bishop can move diagonally. If the betting chip is in the same column as the rook or the same diagonal as the bishop, the player wins. If the chip is on the identical number as the rook or bishop, the player of course wins.

Figure 38:
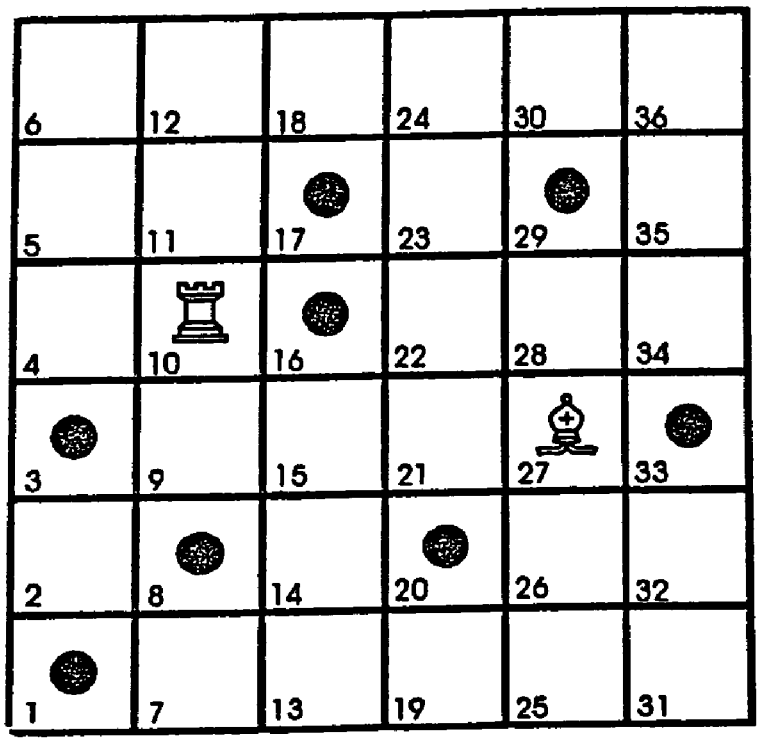

This embodiment is shown in FIG. 38.

For example: The players' bets are placed on cells 1, 3, 8, 16, 17, 20, 19 and 33, the rook is drawn on cell 10 and the bishop on cell 27, as shown in the diagram. The bets placed on cells 8, 16, 17 and 20 are won, and those on cells 1, 3, 29 and 33 are lost. In the case of a winning chip, the player receives double the bet, while in the case of a losing chip, the bet is lost.

Queen Roulette 6×6 Superstar Chess

Each player (1-4) places two bets. A number must be drawn, to which the queen will move. The queen can move diagonally as well as vertically. If the betting chip is in the same diagonal or column, the player wins. If the chip is on the identical number as the queen, of course the player wins. 0=37, that is, that is, 0 functions as any other number. The player determines the size of the bet.

Figure 39:
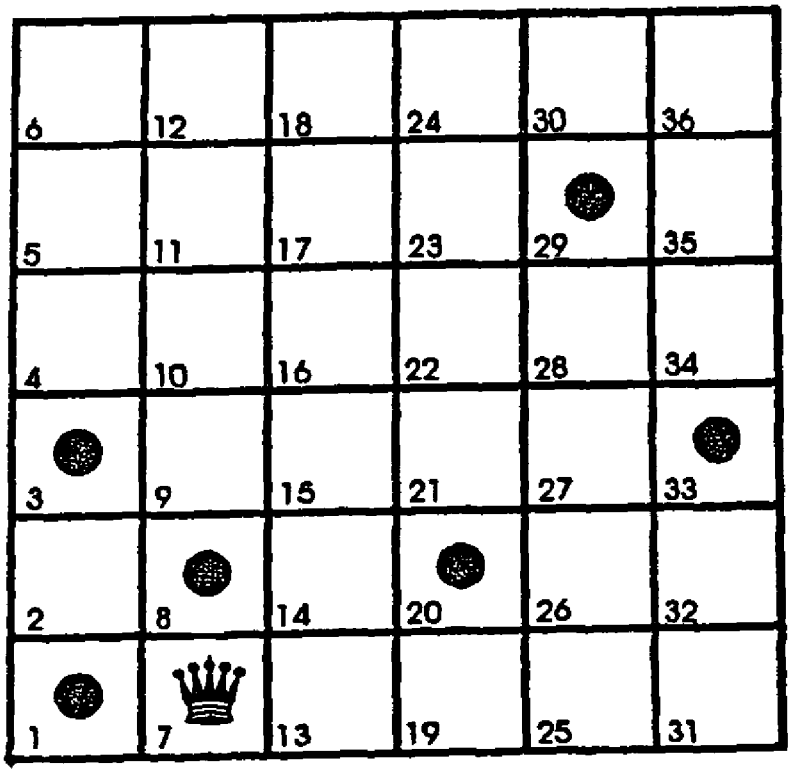

This embodiment is shown in FIG. 39.

For example: The players' bets are placed on cells 1, 3, 8, 20, 29 and 33, and the draw places the queen on cell 7 as shown in the diagram. Bets placed on cells 1 and 8 are won, and those on cells 3, 20, 29 and 33 are lost.

In the case of a winning chip, the player receives double the bet, while in the case of a losing chip, the bet is lost.

King, knight, 2 pawn roulette, 6×6 Superstar Chess

Each of the players (1-4) places two bets. Four number must be drawn on which the king, the knight, and the 2 pawns will move. The pieces and pawns move according to the rules of 6×6 Superstar Chess (see description there). If the betting chip can be "captured" by the above pieces and pawns, the player wins. If the chip is on the identical number as the pieces and pawns, the player also of course wins. 0=37, that is, 0 functions as any other number. The player determines the size of the bet.

For example: The players place their bets on cells 1, 3, 8, 16, 17, 20, 29 and 33. The king is drawn on cell 31, the knight on cell 14, and the pawns on cells 10 and 34, as shown in the diagram. The bets placed on cells 1, 3, 17 and 29 are won, while those placed on cells 8, 16, 20 and 33 are lost.

In the case of a winning chip, the player receives double the bet, while in the case of a losing chip, the bet is lost.

Figure 40:
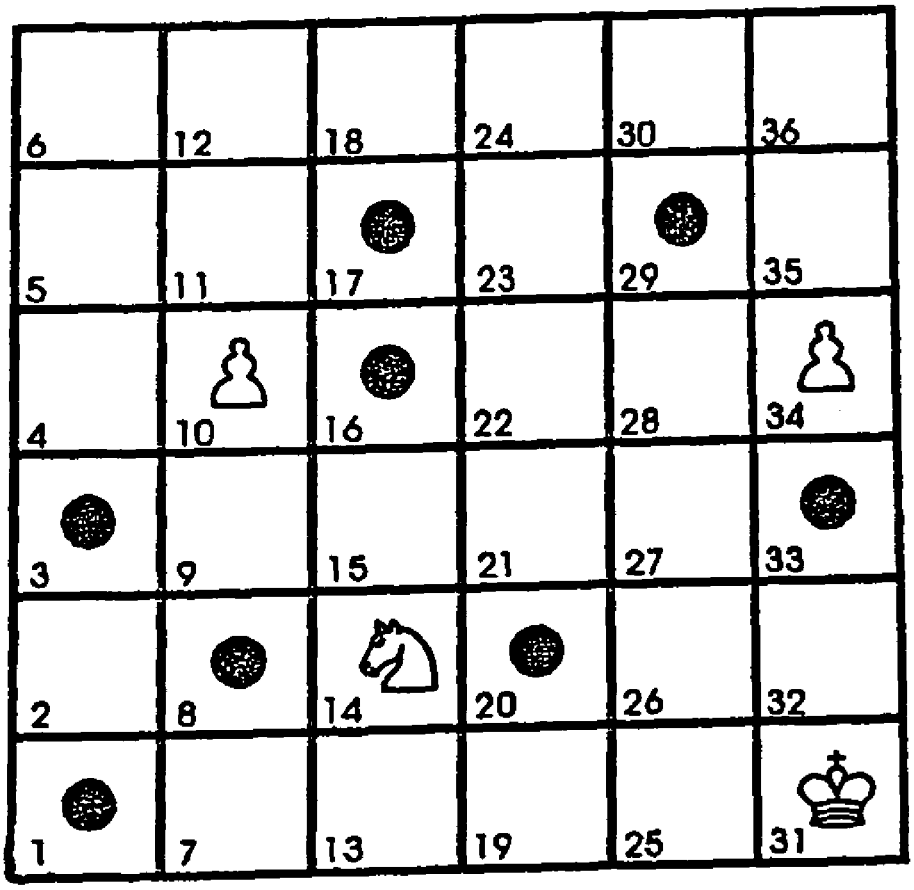

This embodiment is shown in FIG. 40.

Dice Dreidel on a 6×6 board

Players can play for sweets, nuts, money, etc. Bets must be placed in the bank. If the bank becomes empty it must be filled, if the players wish to continue the game. If the bank is not divisible without a remainder, the remainder stays in the bank The game is played with a die numbered 1, 2, 3, 10, 20 and 30. Players move one piece. If a player throws a number that would take him or her beyond the 37 (0) cell, they must complete the move via cell 1. For example, if a player is on cell 31 and throws a 20, then the piece must be end up on cell 14 (31+20-37=14). When moving forward 1, 2, 3, 10, 20 or 30 cells, if a piece ends up on a red cell the player must put into the bank an amount corresponding to the number of cells moved, and if a piece lands on a black cell the player wins the corresponding amount. If a player lands on the 37(0) cell nothing is won or lost.

Dice Black-Jack on a 6×6 board

Players can play for sweets, nuts, money, etc., with bets deposited in the bank. The game is played with a die numbered 1, 2, 3, 10, 20 and 30. Each player has one piece. Pieces move forward the number of cells shown on one throw of the die.

Aim: to reach or get near cell 37. If a player goes beyond cell number 7, the player must decide whether he or she wishes to make a move. A player who goes beyond cell 37 loses. The winning player is the one whose piece reaches cell 37, or whose piece reaches the highest numbered cell before 37. If a player whose piece was behind overtakes the others (from cell 8), the other players can take a further risk by throwing again. If all players land on the same cell and no one wishes to thrown again, the game ends in a draw. If the players then wish to carry on playing, they must begin again from 0, or, if they do not wish to continue playing, the bets in the bank are divided in equal proportions. The players place equal bets and the winner takes all.

Lotto 6×6 Superstar

The game can be played by 2 to 4 persons, or even by 1 person using chips of four colors. Each player must place bets on 7 numbers. Seven different numbers are drawn. The players can choose the size of their bets. The amount they win depends on how many numbers they get right out of the seven. This is illustrated in the table below.

| Number found | Winnings |
|---|---|
| 0 | Gets back the amount of the bet |
| 1 | Loses |
| 2 | Loses |
| 3 | Gets back double the bet placed |
| 4 | Gets back the bet placed + 5 times the bet |
| 5 | Gets back the bet placed + 100 times the bet |
| 6 | Gets back the bet placed + 5,000 times the bet |
| 7 | Gets back the bet placed + 100,000 times the bet |

Figure 41:
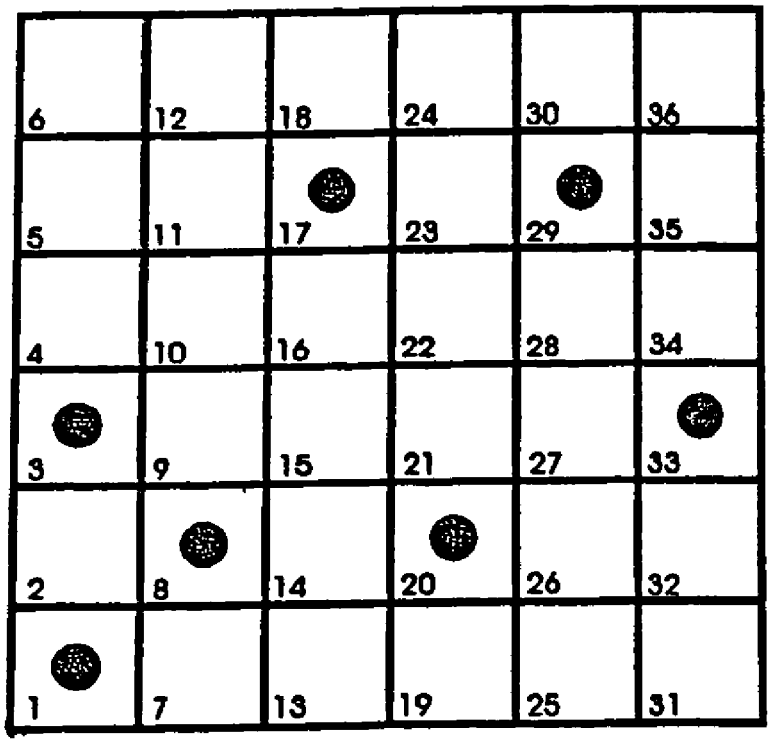

This embodiment is shown in FIG. 41.

Example: The player places chips on the following cells: 1, 3, 8, 17, 20, 29 and 33, as shown in the diagram. The numbers drawn are 4, 9, 15, 27, 28, 32 and 35. In this case the player finds none of the numbers. If, for example, the player's bet was 30 units, he or she gets this back.

| Supersztar 6 × 6 Roulette | |
|---|---|
| Multiple possibilities: | |
| (a) one whole number | 35x |
| (b) two adjacent numbers | 17x |
| (c) four adjacent numbers | 8x |
| (d) six adjacent numbers | 5x |
| (e) twelve adjacent numbers | 2x |
| Simple possibilities: | |
| (f) all even numbers | 2x |
| (g) all odd numbers | 1x |
| (h) all red numbers | 1x |
| (i) all black numbers | 1x |
| (j) 1 to 18 | 1x |
| (k) 19 to 36 | 1x |

If 0 or 00 are drawn, they should be regarded as whole numbers 0 and 00 loses, the bank wins everything.

Figure 42:
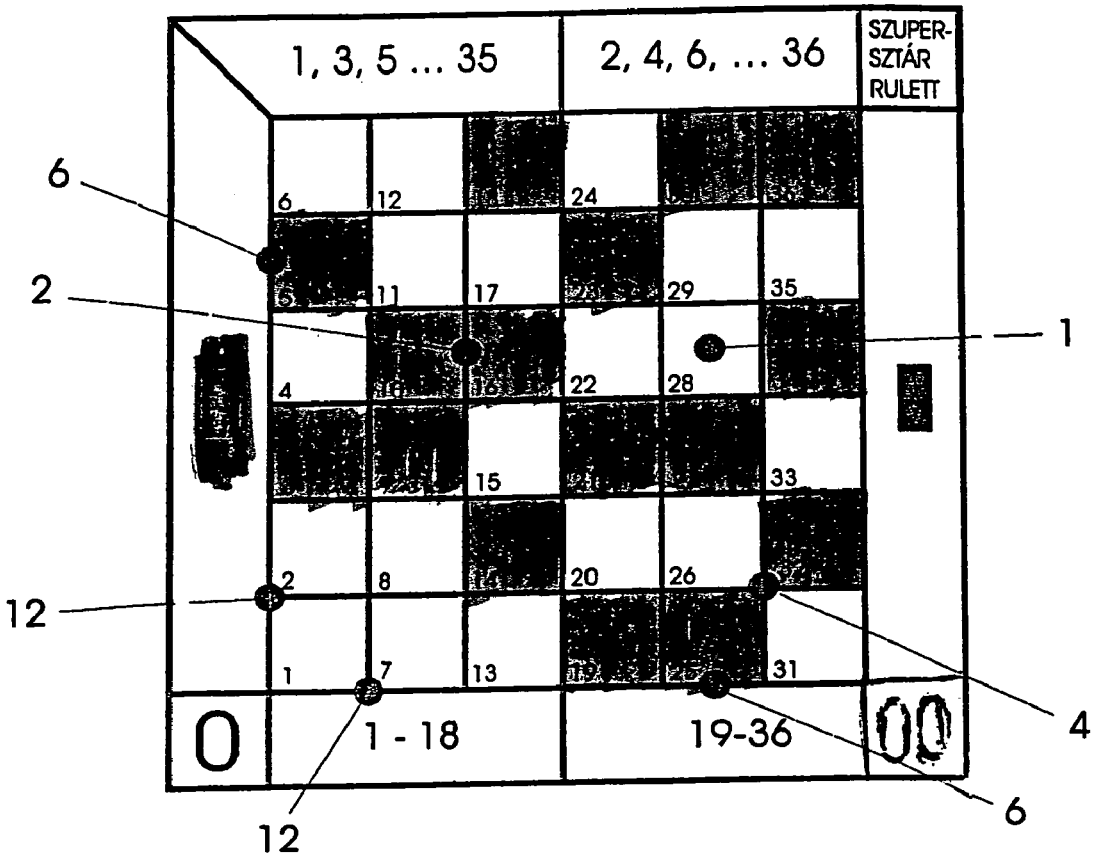

This embodiment is shown in FIG. 42.

What is claimed is:

1. A logical board game having a rectangular playing area made up of primary playing fields, the primary playing fields being congruent squares having four edges in which at least two edges are in contact with adjacent primary playing fields, the board consisting of:

a first playing field having a first edge adjacent to a second edge that are connected to form a first primary corner of said board;

a first row of playing fields connecting to and extending from said first playing field, said first row of playing fields comprising a plurality of interlocking playing fields each having a pair of edges parallel to the first edge of the first playing field, said first row of playing fields terminating in a last playing field having two edges that connect to form a second primary corner of said board;

a second row of playing fields connecting to and extending from said first playing field, said second row of playing fields comprising a plurality of interlocking playing fields each having a pair of edges parallel to the second edge of the first playing field, said second row of playing fields terminating in a last playing field having two edges that connect to form a third primary corner of said board;

a plurality of internal rows of playing fields parallel to said first row of playing fields and connecting to and perpendicular to said second row of playing fields, each said internal row of playing fields extending from a playing field of the second row of playing fields;

an external playing field connecting to said third primary corner of said board, said external playing field being adjacent to said last playing field of said second row of playing fields and said external playing field not sharing any common edges with said last playing field of said second row of playing fields, and said first, second, and third primary corners and said external playing field defining an outer boundary of said game board;

and further consisting of: at least five major chess pieces and at least five pawns, said major chess pieces initially aligned along at least a portion of said outer boundary of said game board extending from one of said first, second, or third primary corners of said game board, said at least five major chess pieces comprising:

a king configured to move from one playing field to any one neighboring playing field;

a pair of queens, each said queen configured to move from one playing field to any number of neighboring playing fields in a diagonal direction that are not occupied by any of the pieces of an opposing player;

a rook configured to move from one playing field to any number of neighboring playing fields in a vertical direction;

a bishop configured to move from one playing field to any number of neighboring playing fields in a diagonal direction; and at least one knight configured to move from one playing field along a path to another playing field, said path comprising two neighboring playing fields in either a vertical or horizontal first direction, followed by one neighboring playing field in a second direction 90 degrees from said first direction; and each said pawn configured to move from one playing field to a neighboring playing field in either a forward vertical or horizontal direction, not to exceed a distance of two neighboring playing fields.

2. The board according to claim 1 wherein the first and second rows of playing fields each comprise six playing fields.

3. The board according to claim 1 wherein the first row of playing fields comprises five playing fields and the second row of playing fields comprises seven playing fields.

4. A logical board game according to claim 1, wherein the rectangular playing area is comprised of six rows of playing fields, each said row comprising six adjoining playing fields.

5. A logical board game according to claim 4, further consisting of a computer and computer program configured for the playing and teaching of horse race; wherein the playing area is configured for the playing of horse race.

6. A logical board game according to claim 4, further consisting of a computer and computer program configured for the playing and teaching of pawn war; wherein the playing area is configured for the playing of pawn war.

7. A logical board game according to claim 4, further consisting of a computer and computer program configured for the playing and teaching of French chess; wherein the playing area is configured for the playing of French chess.

8. A logical board game according to claim 4, further consisting of a computer and computer program configured for the playing and teaching of halma; wherein the playing area is configured for the playing of halma.

9. A logical board game according to claim 4, further consisting of a computer and computer program configured for the playing and teaching of pyramid; wherein the playing area is configured for the playing of pyramid.

10. A logical board game according to claim 4, further consisting of a computer and computer program configured for the playing and teaching of checkers; wherein the playing area is configured for the playing of checkers (shashki).

11. A game-of-chance board game according to claim 4, further consisting of a chess queen and a plurality of tokens for playing the game of (chess-) queen roulette.

12. A game-of-chance board game according to claim 4, further consisting of a set of rook and bishop chess pieces and a plurality of tokens for playing the game of rook-bishop roulette.

13. A game-of-chance board game according to claim 4, further consisting of a set of king, knight and pawn chess pieces and a plurality of tokens for playing the game of king-knight-two pawn roulette.

14. A game-of-chance board game according to claim 4, further consisting of a plurality of tokens for playing the game of lotto.

15. A game-of-chance board game according to claim 4, further consisting of a set of major chess pieces for playing the game of lotto chess.

16. A game-of-chance board game according to claim 4, further consisting of a plurality of tokens for playing the game of roulette.

17. A game-of-chance board game according to claim 4, further consisting of a plurality of tokens for playing the game of dreidel.

18. A game-of-chance board game according to claim 4, further consisting of a plurality of tokens for playing black-jack.

19. A game-of-chance board game according to claim 4, further consisting of a chess queen and a plurality of tokens for playing the game of (chess-) queen roulette.

20. A game-of-chance board game according to claim 4, further consisting of a set of rook and bishop chess pieces and a plurality of tokens for playing the game of rook-bishop roulette.

21. A logical board game according to claim 1, wherein the rectangular playing area is comprised of seven rows of playing fields, each said row comprising five adjoining playing fields.

22. A logical board game according to claim 21, further consisting of a computer and computer program that makes possible the playing and teaching of horse race; wherein the playing area is configured for the playing of horse race.

23. A logical board game according to claim 21, further consisting of a computer and computer program configured for the playing and teaching of pawn war; wherein the playing area is configured for the playing of pawn war.

24. A logical board game according to claim 21, further consisting of a computer and computer program configured for the playing and teaching of French chess; wherein the playing area is configured for the playing of French chess.

25. A logical board game according to claim 21, further consisting of a computer and computer program configured for the playing and teaching of halma; wherein the playing area is configured for the playing of halma.

26. A logical board game according to claim 21, further consisting of a computer and computer program configured for the playing and teaching of pyramid; wherein the playing area is configured for the playing of pyramid.

27. A logical board game according to claim 21, further consisting of a computer and computer program configured for the playing and teaching of checkers; wherein the playing area is configured for the playing of checkers (shashki).

28. A game-of-chance board game according to claim 21, further consisting of a set of king, knight and pawn chess pieces and a plurality of tokens for playing the game of king-knight-two pawn roulette.

29. A game-of-chance board game according to claim 21, further consisting of a plurality of tokens for playing the game of lotto.

30. A game-of-chance board game according to claim 21, further consisting of a set of major chess pieces for playing the game of lotto chess.

31. A game-of-chance board game according to claim 21, further consisting of a plurality of tokens for playing the game of roulette.

32. A game-of-chance board game according to claim 21, further consisting of a plurality of tokens for playing the game of dreidel.

33. A game-of-chance board game according to claim 21, further consisting of a plurality of tokens for playing black-jack.

* * * * *